US007750872B2

(12) United States Patent
Iguchi et al.

(10) Patent No.: US 7,750,872 B2
(45) Date of Patent: Jul. 6, 2010

(54) METHOD FOR DRIVING A FLAT-TYPE DISPLAY DEVICE

(75) Inventors: Yukinobu Iguchi, Gifu (JP); Hiroyuki Ikeda, Gifu (JP); Yasuhito Hatano, Gifu (JP); Kunihiko Nagamine, Gifu (JP)

(73) Assignee: Sony Corporation, Tokyo (JP)

( * ) Notice: Subject to any disclaimer, the term of this patent is extended or adjusted under 35 U.S.C. 154(b) by 840 days.

(21) Appl. No.: 11/654,507

(22) Filed: Jan. 18, 2007

(65) Prior Publication Data

US 2007/0171152 A1 Jul. 26, 2007

(30) Foreign Application Priority Data

Jan. 20, 2006 (JP) ..... 2006-012465

(51) Int. Cl.
*G09G 3/22* (2006.01)

(52) U.S. Cl. ..... 345/75.2

(58) Field of Classification Search ..... None
See application file for complete search history.

(56) References Cited

FOREIGN PATENT DOCUMENTS

JP 2004-534968 11/2004

*Primary Examiner*—Sumati Lefkowitz
*Assistant Examiner*—Tammy Pham
(74) *Attorney, Agent, or Firm*—Rader, Fishman & Grauer PLLC

(57) ABSTRACT

A method for driving a flat-type display device which includes a cathode panel having first electrodes and second electrodes and an anode panel, the cathode panel and the anode panel having spacers is provided. The method includes the steps of: in the non-display operation period of the flat-type display device, determining a normalized first current from a first current by non-display-driving the electron emitter areas near the spacers, and determining a normalized second current from a second current by non-display-driving the electron emitter areas which are not near the spacers; and in the actual display operation period of the flat-type display device, setting the driving conditions for the electron emitter areas on the basis of the normalized first current and normalized second current so that the electron emission conditions in the electron emitter areas near the spacers and not near the spacers are substantially the same.

13 Claims, 20 Drawing Sheets

METHOD FOR DRIVING A FLAT-TYPE DISPLAY DEVICE

CROSS REFERENCES TO RELATED APPLICATIONS

The present document contains subject matter related to Japanese Patent Application JP 2006-012465 filed in the Japanese Patent Office on Jan. 20, 2006, the entire contents of which being incorporated herein by reference.

BACKGROUND OF THE INVENTION

1. Field of the Invention

The present invention relates to a method for driving a flat-type display device.

2. Description of Related Art

As image display devices which will possibly replace cathode-ray tubes (CRTs) currently widely spread, flat (flat panel type) display devices are vigorously studied. Examples of the flat display devices include a liquid crystal display (LCD), an electroluminescence display (ELD), and a plasma display (PDP). In addition, flat display devices having incorporated therein a cathode panel having an electron emission device are also developed. As electron emission devices, a cold cathode field emission device, a metal/insulating film/metal element (also called an MIM element), and a surface conductive-type electron emission device are known, and a flat display device having incorporated therein a cathode panel having the above electron emission device composed of a cold cathode electron source has attracted attention since it advantageously achieves color display with high resolution and high luminance and causes low power consumption.

A cold cathode field emission display device (hereinafter, frequently referred to simply as "display device") is a flat display device having incorporated therein a cold cathode field emission device as an electron emission device. This type of display device generally has a structure having a cathode panel CP and an anode panel AP disposed so that they face each other through a high-vacuum space, and joined together at their edges through a joint member. The cathode panel CP has a plurality of cold cathode field emitter elements (hereinafter, frequently referred to simply as "field emitter element(s)"), and the anode panel AP has a fluorescent region with which electrons emitted from the field emitter elements collide and which is excited to emit light. The cathode panel CP has electron emitter areas being arrayed in a two-dimensional matrix form and corresponding to respective subpixels, in which each electron emitter area has formed one or a plurality of field emission devices. Examples of field emitter elements include those of Spindt type, flattened type, edge type, or flat type.

A schematic fragmentary end view of a typical display device having a Spindt-type field emission device as an example is shown in FIG. 10, and a partial, schematic exploded perspective view of a cathode panel CP and an anode panel AP separated from each other is shown in FIG. 19. The Spindt-type field emission device constituting the display device includes a cathode electrode 11, an insulating layer 12, a gate electrode 13, openings 14, and a conical electron emitter 15. Herein, the cathode electrode 11 is formed on a support 10. The insulating layer 12 is formed on the support 10 and the cathode electrode 11. The gate electrode 13 is formed on the insulating layer 12. The openings 14 are formed in the gate electrode 13 and insulating layer 12, in which a first opening 14A formed in the gate electrode 13 and a second opening 14B formed in the insulating layer 12. The conical electron emitter 15 is formed on the cathode electrode 11 at the bottom of each opening 14.

A schematic fragmentary end view of a display device having a so-called flattened field emission device having a substantially planar electron emitter 15A is shown in FIG. 18. This field emission device is similar to the Spindt-type field emission device as described above, and is different in having an electron emitter 15A formed on the cathode electrode 11 at the bottom of each opening 14, instead of the electron emitter 15. The electron emitter 15A is composed of, for example, a number of carbon nanotubes, part of which is buried in the matrix.

An interlayer dielectric layer 16 is formed on the insulating layer 12 and the gate electrode 13, and an opening (third opening 14C) communicating with the first opening 14A formed in the gate electrode 13 is formed in the interlayer dielectric layer 16, and further a focusing electrode 17 is formed over the interlayer dielectric layer 16 and the sidewall of the third opening 14C. In FIGS. 18 and 19, the interlayer dielectric layer and the focusing electrode are not shown.

In these display devices, the cathode electrode 11 is in the form of a strip extending in the Y direction, and the gate electrode 13 is in the form of a strip extending in the X direct ion different from the Y direction. Generally, the cathode electrode 11 and the gate electrode 13 are formed in strips in respective directions such that the images from the electrodes 11, 13 cross at a right angle. The overlap region where the strip-form cathode electrode 11 and the strip-form gate electrode 13 overlap is an electron emitter area EA, and corresponds to one subpixel. The electron emitter areas EA's are generally arrayed in a two-dimensional matrix form in an effective region EF of the cathode panel CP. The effective region EF means a display region at the center having a practical function of the flat-type display device, i.e., display function. A non-effective region NE is present on the outside of the effective region EF and in the form of a frame surrounding the effective region EF.

On the other hand, the anode panel AP has a structure including fluorescent regions 22 having a predetermined pattern formed on a substrate 20 in which the fluorescent regions 22 are covered with an anode electrode 24. The fluorescent regions 22 specifically include a red light-emitting fluorescent region 22R, a green light-emitting fluorescent region 22G, and a blue light-emitting fluorescent region 22B. A light absorbing layer (black matrix) 23 composed of a light absorbing material, such as carbon, is buried between the fluorescent regions 22 to prevent the occurrence of color mixing in the display image, i.e., optical cross talk. The fluorescent regions 22 constituting one subpixel are individually surrounded by a barrier 21, and the barrier 21 has a flat form of lattice-like form, that is, form of parallel crosses. In the figure, reference numeral 40 designates a spacer, and reference numeral 26 designates a joint member. In FIGS. 18 and 19, the barrier and spacer are not shown.

One subpixel is composed of the electron emitter area EA on the cathode panel side, and the fluorescent region 22 on the anode panel side opposite (facing) the above electron emitter area EA. The pixels on the order of, e.g., several hundred thousand to several million are arrayed in the effective region EF. In the display device making color display, one pixel is composed of an assembly of a red light-emitting subpixel, a green light-emitting subpixel, and a blue light-emitting subpixel. The anode panel AP and the cathode panel CP are arranged so that the electron emitter area EA and the fluorescent region 22 face each other, and they are joined together at their edges through the joint member 26, followed by evaluation and sealing, thus producing a display device. A space between the anode panel AP, the cathode panel CP, and the joint member 26 is a high vacuum (e.g., $1\times10^{-3}$ Pa or less).

Therefore, the spacer 40 must be placed between the anode panel AP and the cathode panel CP for preventing the display device from suffering damage due to atmospheric pressure. Generally, an antistatic film (not shown in the figures) comprised of, e.g., $CrO_x$ or $CrAl_xO_y$ is formed on the sidewall of the spacer 40.

In driving the display device, a linear sequential driving mode is frequently employed. The linear sequential driving mode is a mode in which, among a group of electrodes crossing in a matrix form, for example, the gate electrodes 13 are used as scanning electrodes (the number of M) and the cathode electrodes 11 are used as data electrodes (the number of N), and the gate electrodes 13 are selected and scanned and an image is displayed according to a signal to the cathode electrodes 11 to constitute one frame. In the linear sequential driving mode, electron emission from each electron emitter area EA is performed in a selected time of the scanning electrode, i.e., only in a so-called duty period of the scanning electrode. The duty period is a value in terms of second obtained by dividing a refresh time (e.g., 16.7 msec at 60 Hz) of a frame by M.

More specifically, a relatively negative voltage is applied to the cathode electrode 11 from a cathode electrode control circuit 31, and a relatively positive voltage is applied to the gate electrode 13 from a gate electrode control circuit 32. For example, 0 V is applied to the focusing electrode 17 from a focusing electrode control circuit 33, and a positive voltage higher than the voltage applied to the gate electrode 13 is applied to the anode electrode 24 from an anode electrode control circuit 34. In display made by the display device, a video signal is input into the cathode electrode 11 from the cathode electrode control circuit 31, and a scanning signal is input into the gate electrode 13 from the gate electrode control circuit 32. An electric field resulting from applying a voltage across the cathode electrode 11 and the gate electrode 13 causes the electron emitter 15 or 15A to emit electrons due to a quantum tunnel effect. The electrons are attracted by the anode electrode 24 and pass through the anode electrode 24 and collide with the fluorescent regions 22, so that the fluorescent regions 22 are excited to emit light, thus obtaining a desired image. Accordingly, the operation of the cold cathode field emission display device is basically controlled by changing the voltage applied to the gate electrode 13 and the voltage applied to the cathode electrode 11.

When electrons emitted from the electron emitter areas EA near the spacer 40 pass through the anode electrode 24 in the anode panel AP and collide with the fluorescent regions 22, part of the electrons backscatter at the fluorescent regions 22 and part of the resultant backscattering electrons collide with the spacer 40. Consequently, gas adsorbed on the spacer 40 is released, and molecules of the gas and others are attached to or adsorbed on the surface of the electron emitter 15 or 15A constituting the electron emitter areas EA near the spacer 40, causing a phenomenon such that the electron emission properties of the electron emitter 15 or 15A deteriorate. Such a phenomenon lowers electron emission from the electron emitter areas EA near the spacer 40, so that a difference is caused between the light emission conditions in the fluorescent regions 22 near the spacer 40 and the light emission conditions in the fluorescent regions 22 which are not near the spacer 40 or are far away from the spacer 40.

This state is diagrammatically shown in FIG. 20A. In FIG. 20A, a relative anode current flowing between the electron emitter area and the anode electrode due to the electrons emitted from each electron emitter area is taken as the ordinate (relative anode current). The numbers assigned to the positions of the electron emitter areas near the spacer in the Y direction are taken as the abscissa, and an electron emitter area having the smaller number is nearer the spacer. From FIG. 20A, it is found that the amount of electrons emitted from the electron emitter areas near the spacer is smaller than the amount of electrons emitted from the electron emitter areas far away from the spacer.

The conditions of electron emission from the electron emitter areas change with time. This state is diagrammatically shown in FIG. 20B. In FIG. 20B, a value obtained by dividing a value of anode current flowing between the electron emitter area and the anode electrode due to the electrons emitted from the electron emitter areas near the spacer by a value of anode current flowing between the electron emitter area and the anode electrode due to the electrons emitted from the electron emitter areas far away from the spacer is taken as the ordinate (relative anode current ratio), and a lapse of time (unit: optional) is taken as the abscissa. From FIG. 20B, it is found that, as a period of time lapses, the decrease of the anode current flowing between the electron emitter area and the anode electrode due to the electrons emitted from the electron emitter areas near the spacer becomes larger than the decrease of the anode current flowing between the electron emitter area and the anode electrode due to the electrons emitted from the electron emitter areas far away from the spacer. In other words, it is found that, as a period of time lapses, a difference is caused between the change of the electron emission properties in the electron emitter areas near the spacer and the change of the electron emission properties in the electron emitter areas far away from the spacer.

A method for solving the above problem is disclosed in, for example, Japanese Translation of PCT International Application (KOHYO) No. 2004-534968.

SUMMARY OF THE INVENTION

However, the patent document fails to describe how to narrow the difference between the light emission conditions in the fluorescent regions near the spacer and the light emission conditions in the fluorescent regions which are not near the spacer. Furthermore, the patent document has no description of a specific method of compensating for a change with time in the conditions of electron emission from the electron emitter areas.

Accordingly, the present invention provides a method for driving a flat-type display device, which can narrow the difference between the light emission conditions in the fluorescent regions near the spacer and the light emission conditions in the fluorescent regions which are not near the spacer. Further, the present invention also provides a method for driving a flat-type display device, which can compensate for a change with time in the conditions of electron emission from the electron emitter areas.

For achieving the first task, the method for driving a flat-type display device of the present invention is a method for driving a flat-type display device which includes:

(A) a cathode panel having M strip-form first electrodes extending in a first direction and N strip-form second electrodes extending in a second direction different from the first direction, and having N×M electron emitter areas composed of overlap regions between the first electrodes and the second electrodes; and (B) an anode panel having a fluorescent region and an anode electrode, in which:

the cathode panel and the anode panel being joined together at their edges through a joint member, the cathode panel and the anode panel having therebetween spacers extending in the first direction arranged in P rows, the method including the steps of:

in the non-display operation period of the flat-type display device, determining a normalized first current $I_{Nor_near}$ by non-display-driving the electron emitter areas near the spacers and measuring a first current $I_{near}$ carried by electrons emitted from the above electron emitter areas, and determining a normalized second current $I_{Nor_far}$ by non-display-driving the electron emitter areas which are not near the spacers and measuring a second current $I_{far}$ carried by electrons emitted from the above electron emitter areas; and in the actual display operation period of the flat-type display device, setting the driving conditions for the electron emitter areas based on the normalized first current $I_{Nor_near}$ and normalized second current $I_{Nor_far}$ so that the electron emission conditions in the electron emitter areas near the spacers and the electron emission conditions in the electron emitter areas which are not near the spacers are substantially the same.

In the following descriptions, the electron emitter area near the spacer is frequently referred to as "near electron emitter area", and the electron emitter area which is not near the spacer is frequently referred to as "far electron emitter area". The first electrode near the spacer is frequently referred to as "near first electrode", and the first electrode which is not near the spacer is frequently referred to as "far first electrode". It is noted that (P−1) first electrode groups are disposed between one spacer and another spacer wherein each first electrode group is composed of Q first electrodes, and, in the Q first electrodes, R (R≧1) first electrode(s) constitutes or constitute electron emitter areas near one spacer and R' (R'≧1) first electrode(s) constitutes or constitute electron emitter areas near another spacer. Q, R, and R' may be respectively either the same in each first electrode group or different between the first electrode groups.

The non-display operation period of the flat-type display device indicates a state such that electrons are actually emitted from the electron emitter areas, but no image is displayed on the flat-type display device, or a state such that no actual image is displayed, but, for example, test patterns, or figures or characters, such as "Testing", are displayed. The electron emitter areas in this state are non-display-driven. The actual display operation period of the flat-type display device indicates a state such that electrons are actually emitted from the electron emitter areas and an image is actually displayed on the flat-type display device, or a state such that an image is displayed. The near electron emitter area (near first electrode) may be indicative of, in respect of one spacer and one region in two regions defined by the spacer, N electron emitter areas (one first electrode) nearest the spacer, or R×N or R'×N electron emitter areas (R or R' first electrodes) near the spacer. The term "N electron emitter areas" involves N electron emitter areas divided into a plurality of electron emitter areas. With respect to each of R and R', there is no limitation, and they can individually be, for example, a positive integer (natural number) of 1 to 8. R=R' or R≠R' can be satisfied. Alternatively, $R \leqq R_0$ or $R' \leqq R_0$ can be satisfied wherein $R_0$ represents the number of the first electrodes present in a region having a distance from the spacer up to twice a horizontal distance $D_0$ wherein $D_0$ represents a distance between the anode panel and the cathode panel. This applies to the following descriptions. Further alternatively, R and R' may be determined by preparing a flat-type display device and checking the difference in the second direction between the light emission conditions in the fluorescent regions near the spacer and the light emission conditions in the fluorescent regions which are not near the spacer. The far electron emitter area (far first electrode) means an electron emitter area (or first electrode) other than the above-mentioned near electron emitter areas (near first electrodes). It is desired that the driving conditions for non-display-driving the electron emitter areas in the non-display operation period of the flat-type display device are the same as the driving conditions for display-driving the electron emitter areas in the actual display operation period of the flat-type display device such that the largest current is obtained (e.g., the difference between the voltage applied to the first electrode and the voltage applied to the second electrode is the largest), but the driving conditions are not limited to them.

In the non-display operation period of the flat-type display device, the near electron emitter areas are non-display-driven and a first current $I_{near}$ carried by electrons emitted from the near electron emitter areas is measured to determine a normalized first current $I_{Nor_near}$. Specifically, a normalized first current $I_{Nor_near}$ can be determined, for example, from the following formula:

$$I_{Nor_near}=I_{near}/\alpha$$

wherein α represents the number of the near electron emitter areas which are non-display-driven (at least N, R×N, or R'×N), or the following formula:

$$I_{Nor_near}=I_{near}/\alpha'$$

wherein α' represents the number of the near first electrode(s) (at least one, R, or R').

In the non-display operation period of the flat-type display device, the far electron emitter areas are non-display-driven and a second current $I_{far}$ carried by electrons emitted from the far electron emitter areas is measured to determine a normalized second current $I_{Nor_far}$. Specifically, a normalized second current $I_{Nor_far}$ can be determined, for example, from the following formula:

$$I_{Nor_far}=I_{far}/\beta$$

wherein β represents the number of the far electron emitter areas which are non-display-driven (at least N or (Q−R−R')×N), or the following formula:

$$I_{Nor_far}=I_{far}/\beta'$$

wherein β' represents the number of the far first electrode(s) (at least one or (Q−R−R')).

The above formulae are examples of the method for determining $I_{Nor_near}$ or $I_{Nor_far}$, and they can be appropriately changed to, for example, $$I_{Nor_near}=I_{near}$$

$$I_{Nor_far}=I_{far}.$$

This applies to the following descriptions.

Further, in the actual display operation period of the flat-type display device, the driving conditions for the electron emitter areas are set on the basis of the normalized first current $I_{Nor_near}$ and the normalized second current $I_{Nor_far}$ so that the electron emission conditions in the near electron emitter areas and the electron emission conditions in the far electron emitter areas are substantially the same. Specifically, the driving conditions are set so that, for example, the luminance values are substantially the same. In a case where, for example, a linear sequential driving mode is employed, the first electrode is used as a scanning electrode, and the second electrode is used as a data electrode, a voltage (constant value) $V_{1_near}$ applied to the first electrode constituting the near electron emitter areas can be determined from the following formula (1):

$$\gamma \cdot \ln(V_{1_near}/V_{1_far}) = \ln(I_{Nor_far}/I_{Nor_near}) \quad (1)$$

wherein $V_{1_far}$ represents a voltage applied to the first electrode constituting the far electron emitter areas, which is constant; $V_2$ represents a voltage applied to the second electrode constituting the electron emitter areas, which is variable according the video signal; and $\gamma$ represents a constant of about 3, specifically, determined by various examinations.

The $I_{Nor_far}/I_{Nor_near}$ value and the $V_{1_near}$ value according to this value are determined from the formula (1) above, and stored as a kind of reference table in a memory means in the flat-type display device, so that the voltage value $V_{1_near}$ can be fed to the electron emitter areas by a known method. In a case where the electron emitter areas are driven by a pulsed voltage, a system in which the pulse number in the near electron emitter areas is $(I_{Nor_far}/I_{Nor_near})\times k$ (k: constant) times the pulse number in the far electron emitter areas, or a system which controls the phase may be employed. The above descriptions can be applied to the below-described embodiments of the method for driving a flat-type display device.

The method for driving a flat-type display device of the present invention may have a mode in which (P−1) first electrode groups are disposed between one spacer and another spacer in which each first electrode group is composed of Q first electrodes, in which, in the Q first electrodes, R (R≧1) first electrode(s) constitutes or constitute electron emitter areas near one spacer and R' (R'≧1) first electrode(s) constitutes or constitute electron emitter areas near another spacer, in which the method includes the steps of:

determining a normalized first current $I_{Nor_near(r)}$ by non-display-driving the electron emitter areas composed of the first electrodes of from the 1st first electrode nearest the one spacer to the R-th first electrode and the (Q−R'+1)-th through Q-th first electrodes every each first electrode, and measuring a first current $I_{near(r)}$ (wherein r=1, 2, . . . , R, and Q−R'+1, . . . , Q−1, Q) carried by electrons emitted from the above electron emitter areas to, and determining a normalized second current $I_{Nor_far}$ by non-display-driving simultaneously or successively the electron emitter areas comprised of the (R+1)-th through (Q−R')-th first electrodes, and measuring a second current $I_{far_sum}$ carried by electrons emitted from the above electron emitter areas; and setting the driving conditions for the electron emitter areas every each first electrode constituting the electron emitter areas near the spacers so that the electron emission conditions in the electron emitter areas comprised of the above first electrodes and the electron emission conditions in the electron emitter areas which are not near the spacers are substantially the same.

The above method of driving a flat-type display device of the present invention is, for convenience, frequently referred to as "method-A" for driving a flat-type display device of the present invention. In this method, the currents $I_{near(r)}$ are individually measured. In the method having this construction, for example, the measured current is considerably increased, thus further improving the measurement precision.

The method-A for driving a flat-type display device of the present invention may have a mode in which the operations of measuring the first currents $I_{near(r)}$ in the respective P−1 first electrode groups are performed simultaneously in the (P−1) groups, and the normalized first current $I_{Nor_near(r)}$ is determined from the sum $I_{near_sum(r)}$ of (P−1) first currents $I_{near(r)}$ from the individual first electrode groups, and in which the normalized second current $I_{Nor_far}$ is determined from the sum $I_{far_Gsum}$ of (P−1) second currents $I_{far_sum}$ from the individual first electrode groups.

The above method for driving a flat-type display device of the present invention is, for convenience, frequently referred to as "method-A'" for driving a flat-type display device of the present invention. In this method, the currents $I_{near(r)}$ are individually measured.

The method for driving a flat-type display device of the present invention may have a mode in which (P−1) first electrode groups are disposed between one spacer and another spacer in which each first electrode group is composed of Q first electrodes, in which, in the Q first electrodes, R (R≧1) first electrode(s) constitutes or constitute electron emitter areas near one spacer and R' (R'≧1) first electrode(s) constitutes or constitute electron emitter areas near another spacer, in which the method includes the steps of:

determining a normalized first current $I_{Nor_near}$ by non-display-driving simultaneously the electron emitter areas comprised of the first electrodes of from the 1st first electrode nearest the one spacer to the R-th first electrode and the (Q−R'+1)-th through Q-th first electrodes, and measuring a first current $I_{near_sum}$ carried by electrons emitted from the above electron emitter areas, and determine a normalized second current $I_{Nor_far}$ by non-display-driving simultaneously the electron emitter areas comprised of the (R+1)-th through (Q−R')-th first electrodes, and measuring a second current $I_{far_sum}$ carried by electrons emitted from the above electron emitter areas; and setting the driving conditions for the electron emitter areas so that, in the R+R' first electrodes constituting the electron emitter areas near the spacers, the electron emission conditions in the electron emitter areas comprised of the above first electrodes and the electron emission conditions in the electron emitter areas which are not near the spacers are substantially the same.

The above method for driving a flat-type display device of the present invention is, for convenience, frequently referred to as "method-B" for driving a flat-type display device of the present invention. In this method, the currents $I_{near(r)}$ are simultaneously measured to obtain a first current $I_{near_sum}$. In the method having this construction, the measured current is considerably increased, thus further improving the measurement precision.

The method-B for driving a flat-type display device of the present invention may have a mode in which the operations of measuring the first currents $I_{near_sum}$ in the respective (P−1) first electrode groups are performed simultaneously in the (P−1) groups, and the normalized first current $I_{Nor_near}$ is determined from the sum $I_{near_Gsum}$ of (P−1) first currents $I_{near_sum}$ from the individual first electrode groups, and in which the normalized second current $I_{Nor_far}$ is determined from the sum $I_{far_Gsum}$ of (P−1) second currents $I_{far_sum}$ from the individual first electrode groups.

The above method for driving a flat-type display device of the present invention is, for convenience, frequently referred to as "method-B" for driving a flat-type display device of the present invention. In this method, the currents $I_{near(r)}$ are simultaneously measured to obtain a first current $I_{near_sum}$.

In the method for driving a flat-type display device of the present invention including the above mode, the non-display operation period of the flat-type display device can be a predetermined period of time (e.g., several seconds) from the start of power supply to the flat-type display device (switching on), and, in this case, the non-display operation of the flat-type display device is finished and then, an actual display operation of the flat-type display device is started. In the actual display operation of the flat-type display device, the driving conditions for the electron emitter areas are set on the basis of the normalized first current $I_{Nor_near}$ and the normalized second current $I_{Nor_far}$ or the like stored in a memory means in the flat-type display device so that the electron emission conditions in the near electron emitter areas and the electron emission conditions in the far electron emitter areas are substantially the same. Alternatively, the non-display operation period of the flat-type display device can be a predetermined period of time (e.g., several seconds) from the termination of power supply to the flat-type display device (switching off), and, in this case, the non-display operation of the flat-type display device is finished and then, the operation of the flat-type display device is completely stopped. In the next actual display operation of the flat-type display device, the driving conditions for the electron emitter areas are set based on the normalized first current $I_{Nor_near}$ and normalized second current $I_{Nor_far}$ or the like stored in a memory means in the flat-type display device so that the electron emission conditions in the near electron emitter areas and the electron emission conditions in the far electron emitter areas are substantially the same.

The normalized first current $I_{Nor_near}$ and the normalized second current $I_{Nor_far}$ at the start of power supply (switching on) or at the termination of power supply (switching off) are stored in memory means in the flat-type display device every start of power supply (switching on) or termination of power supply (switching off), and the data is accumulated and equalized, thus making it possible to reduce the error to a considerably low level.

The method for driving a flat-type display device of the present invention including the above mode may comprise, in the non-display operation period of the flat-type display device, non-display-driving the electron emitter areas near the spacers to measure a first current $I_{near}$ carried by electrons which are emitted from the above electron emitter areas and collide with the anode electrode, and non-display-driving the electron emitter areas which are not near the spacers to measure a second current $I_{far}$ carried by electrons which are emitted from the above electron emitter areas and collide with the anode electrode.

Generally, electrons pass through the anode electrode to cause the fluorescent regions to emit light. However, a so-called dead voltage (light emission threshold voltage) is present, and the voltage (anode voltage) applied to the anode electrode is generally adjusted to 2 kV to 5 kV, which varies depending on the thickness of the anode electrode, thus suppressing visible light emission. Therefore, when a voltage $V_{A_test}$ applied to the anode electrode in the non-display operation period of the flat-type display device is adjusted to the dead voltage or less, that is, the anode voltage applied to the anode electrode is adjusted to 2 to 5 kV, or when the relationship: $0.05 \leqq V_{A_test}/V_A \leqq 0.5$ is satisfied, where $V_A$ represents a voltage applied to the anode electrode in the actual display operation period of the flat-type display device, there can be obtained a state such that substantially no image is displayed on the flat-type display device. A first current $I_{near}$ or second current $I_{far}$ carried by electrons which collide with the anode electrode is measured, specifically, e.g., a current (anode current) flowing the anode electrode may be measured.

In the method for driving a flat-type display device of the present invention including the above mode, the cathode panel may further include a focusing electrode, in which the method includes the steps of, in the non-display operation period of the flat-type display device, non-display-driving the electron emitter areas near the spacers to measure a first current $I_{near}$ carried by electrons which are emitted from the above electron emitter areas and collide with the focusing electrode, and non-display-driving the electron emitter areas which are not near the spacers to measure a second current $I_{far}$ carried by electrons which are emitted from the above electron emitter areas and collide with the focusing electrode, and, in this case, substantially no image is displayed on the flat-type display device.

In this case, as an example of a voltage $V_{F_test}$ applied to the focusing electrode, there can be mentioned a voltage obtained by adding 10 V to 100 V to the maximum voltage applied to any one of the first electrode and the second electrode, which is nearer the focusing electrode. A first current $I_{near}$ or a second current $I_{far}$ carried by electrons which collide with the focusing electrode is measured, specifically, e.g., a current flowing the focusing electrode may be measured. Further, in this case, the anode voltage applied to the anode electrode is preferably a voltage such that electrons cannot reach the anode electrode, e.g., 0 V.

In the method for driving a flat-type display device of the present invention including the above mode or construction, a non-display driving time $T_{OP_test}$ of the electron emitter areas in the non-display operation period of the flat-type display device may be longer than a display driving time $T_{OP}$ of the electron emitter areas in the actual display operation period of the flat-type display device. As an example of the $T_{OP_test}/T_{OP}$ relationship, there can be exemplified: $5 \leqq T_{OP_test}/T_{OP} \leqq 50$. The display driving time $T_{OP}$ corresponds to the duty period, which is a value in terms of second obtained by dividing a refresh time (e.g., 16.7 msec at 60 Hz) of a frame by M. Thus, non-display-driving the flat-type display device at a low frequency such that the non-display driving time $T_{OP_test}$ is longer than the display driving time $T_{OP}$ not only can increase the measured current to improve the measurement precision but also can prevent the occurrence of a problem in that the driving current wave form in the non-display driving broadens to lower the measurement precision.

Further, the method for driving a flat-type display device of the present invention including the above mode or construction may include the steps of determining a reference normalized second current $I_{Int_Nor_far}$, and, in the actual display operation period of the flat-type display device, setting the driving conditions for the electron emitter areas on the basis of the reference normalized second current $I_{Int_Nor_far}$ and normalized second current $I_{Nor_far}$ and the normalized first current $I_{Nor_near}$ and normalized second current $I_{Nor_far}$ so that the electron emission conditions in the electron emitter areas near the spacers and the electron emission conditions in the electron emitter areas which are not near the spacers are substantially the same, and this method achieves a method for driving a flat-type display device, which can compensate for a change with time in the conditions of electron emission from the electron emitter areas.

The method for driving a flat-type display device of the present invention including the above mode or construction may include the steps of determining a reference normalized first current $I_{Int_Nor_near}$, and, in the actual display operation period of the flat-type display device, setting the driving conditions for the electron emitter areas on the basis of the reference normalized first current $I_{Int_Nor_near}$ and normalized first current $I_{Nor_near}$ and the normalized first current $I_{Nor_near}$ and normalized second current $I_{Nor_far}$ so that the electron emission conditions in the electron emitter areas near the spacers and the electron emission conditions in the electron emitter areas which are not near the spacers are substantially the same, and this method achieves a method for driving a flat-type display device, which can compensate for a change with time in the conditions of electron emission from the electron emitter areas.

The reference normalized second current $I_{Int_Nor_far}$ and reference normalized first current $I_{Int_Nor_near}$ can be obtained in accordance with the method for driving a flat-type display device of the present invention including the method-A, method-A', method-B, or method-B' for driving a flat-type display device of the present invention. The construction in which the reference normalized second current $I_{Int_Nor_far}$ which is the normalized second current $I_{Nor_far}$ of the flat-type display device just produced is preliminarily determined and the construction in which the reference normalized first current $I_{Int_Nor_near}$ which is the normalized first current $I_{Nor_near}$ of the flat-type display device just produced is preliminarily determined may be combined.

In the methods for driving a flat-type display device of the present invention including the above preferred embodiments or constructions (hereinafter, these are frequently referred to simply as "the present invention"), examples of supports constituting the cathode panel or substrates constituting the anode panel include a glass substrate, a glass substrate having an insulating film formed on its surface, a quartz substrate, a quartz substrate having an insulating film formed on its surface, and a semiconductor substrate having an insulating film formed on its surface, but, from a viewpoint of reducing the production cost, a glass substrate or a glass substrate having an insulating film formed on its surface is preferably used. Examples of glass substrates include high distortion point glass, soda glass ($Na_2O.CaO.SiO_2$), borosilicate glass ($Na_2O.B_2O_3.SiO_2$), forsterite ($2MgO.SiO_2$), lead glass ($Na_2O.PbO.SiO_2$), and non-alkali glass.

In the cathode panel according to the embodiment in the present invention, it is preferred that the image from the first electrode and the image from the second electrode cross at a right angle, that is, the first direction and the second direction cross at a right angle from a viewpoint of achieving the flat-type display device having a simplified structure.

In the present invention, specific examples of combinations (N, M) of the number (N) of the second electrodes and the number (M) of the first electrodes include resolutions for image display, such as VGA (640, 480), S-VGA (800, 600), XGA (1,024, 768), APRC (1,152, 900), S-XGA (1,280, 1,024), U-XGA (1,600, 1,200), HD-TV (1,920, 1,080), Q-XGA (2,048, 1,536), (1,920, 1,035), (720, 480), and (1,280, 960), but the resolution is not limited to these values.

In the present invention, examples of electron emitter elements constituting the electron emitter areas include a cold cathode field emitter element (hereinafter, referred to simply as "field emitter element"), a metal/insulating film/metal element (MIM element), and a surface conductive-type electron emitter element. Examples of flat-type display devices include a flat-type display device having a cold cathode field emitter element (cold cathode field emission display device), a flat-type display device having incorporated an MIM element, and a flat-type display device having incorporated a surface conductive-type electron emitter element.

In a case where the flat-type display device is a cold cathode field emission display device having a cold cathode field emitter element (referred to simply as "field emitter element"), the field emitter element includes:

(a) a strip-form cathode electrode formed on a support;

(b) an insulating layer formed on the support and cathode electrode;

(c) a strip-form gate electrode formed on the insulating layer;

(d) openings formed in portions of the gate electrode and insulating layer in the overlap portion where the cathode electrode and the gate electrode overlap, in which the cathode electrode is exposed through the bottom of each opening; and (e) an electron emitter formed on the cathode electrode exposed through the bottom of each opening, and controlled in respect of electron emission by the application of a voltage to the cathode electrode and gate electrode. In the field emitter element, an electron emitter area is composed of one or a plurality of field emitter elements, the field emitter element may have a mode in which the gate electrode corresponds to the first electrode and the cathode electrode corresponds to the second electrode, or a mode in which the cathode electrode corresponds to the first electrode and the gate electrode corresponds to the second electrode.

With respect to the type of the field emitter element, there is no particular limitation, and examples include a Spindt-type field emitter element (field emitter element having a conical electron emitter formed on the cathode electrode at the bottom of each opening) and a flattened-type field emitter element (field emitter element having a substantially planar electron emitter formed on the cathode electrode at the bottom of each opening). In the cathode panel, the overlap portion (overlap region) where the first electrode (gate electrode or cathode electrode) and the second electrode (cathode electrode or gate electrode) overlap constitutes the electron emitter area, and the electron emitter areas are arrayed in a two-dimensional matrix form, and each electron emitter area has one or a plurality of field emitter elements.

In the cold cathode field emission display device, in an actual display operation, a strong electric field resulting from the application of a voltage across the first electrode (gate electrode or cathode electrode) and the second electrode (cathode electrode or gate electrode) is applied to the electron emitter, so that electrons are emitted from the electron emitter due to a quantum tunnel effect. The electrons are attracted by the anode panel due to the anode electrode in the anode panel, and collide with the fluorescent regions. The collision of the electrons with the fluorescent regions causes the fluorescent regions to emit light, which can be recognized as an image.

In the cold cathode field emission display device, the cathode electrode is connected to a cathode electrode control circuit, the gate electrode is connected to a gate electrode control circuit, and the anode electrode is connected to an anode electrode control circuit. These control circuits can be configured with a known circuit. In an actual display operation, an output voltage (anode voltage $V_A$) of the anode electrode control circuit is generally constant, and can be, for example, 5 kV to 15 kV. It is desired that a $V_A/D_0$ (unit: kV/mm) value is 0.5 to 20, preferably 1 to 10, further preferably 4 to 8, where $D_0$ is a distance between the anode panel and the cathode panel (where $0.5\ mm \leqq D_0 \leqq 10\ mm$). In the actual display operation of the cold cathode field emission display device, with respect to the voltage $V_C$ applied to the cathode electrode and the voltage $V_G$ applied to the gate electrode, a voltage modulation mode can be used as a gray level control mode.

The field emitter element can be generally produced by the following method including:

(1) a step of forming a cathode electrode on a support;

(2) a step of forming an insulating layer on the entire surface (on the support and the cathode electrode);

(3) a step of forming a gate electrode on the insulating layer;

(4) a step of forming openings in portions of the gate electrode and the insulating layer in the overlap portion (overlap region) between the cathode electrode and the gate electrode so that the cathode electrode is exposed through the bottom of each opening; and (5) a step of forming an electron emitter on the cathode electrode at the bottom of each opening.

Alternatively, the field emitter element can be produced by the following method including:

(1) a step of forming a cathode electrode on a support;

(2) a step of forming an electron emitter on the cathode electrode;

(3) a step of forming an insulating layer on the entire surface (on the support and electron emitter, or on the support, cathode electrode, and electron emitter);

(4) a step of forming a gate electrode on the insulating layer; and (5) a step of forming openings in portions of the gate electrode and insulating layer in the overlap portion (overlap region) between the cathode electrode and the gate electrode so that the electron emitter is exposed through the bottom of each opening.

In the present invention, in a case where the field emitter element has a focusing electrode, the field emitter element may have a structure in which the focusing electrode is formed on an interlayer dielectric layer which is further formed on the gate electrode and insulating layer, or a structure in which the focusing electrode is formed at the upper portion of the gate electrode. The focusing electrode is an electrode for focusing the track of electrons emitted from the openings toward the anode electrode to improve the luminance or to prevent optical cross talk between the adjacent pixels. In a so-called high voltage-type cold cathode field emission display device having a potential difference between the anode electrode and the cathode electrode on the order of several kV or more and having a relatively large distance between the anode electrode and the cathode electrode, the focusing electrode is especially effective. A relatively negative voltage (e.g., 0 V) is applied to the focusing electrode from a focusing electrode control circuit. The focusing electrode is not necessarily formed so that it individually surrounds each electron emitter or electron emitter area formed in the overlap region where the cathode electrode and the gate electrode overlap. Focusing electrodes may, however, extend in a predetermined array direction of the electron emitters or electron emitter areas. Alternatively, a single focusing electrode may surround the all electron emitters or electron emitter areas, that is, the focusing electrode may have a structure of one thin sheet covering the whole effective region, thus offering a focusing effect common to a plurality of field emitter elements or electron emitter areas. It is noted that an opening (third opening) is formed in the focusing electrode and interlayer dielectric layer.

The effective region is a display region at the center having a practical function of the flat-type display device, i.e., display function, and the non-effective region is present on the outside of the effective region and in the form of a frame surrounding the effective region.

Examples of materials constituting the first electrode, second electrode, cathode electrode, gate electrode, or focusing electrode include various metals including metals, such as chromium (Cr), aluminum (Al), tungsten (W), niobium (Nb), tantalum (Ta), molybdenum (Mo), copper (Cu), gold (Au), silver (Ag), titanium (Ti), nickel (Ni), cobalt (Co), zirconium (Zr), iron (Fe), platinum (Pt), and zinc (Zn); alloys (e.g., MoW) or compounds (e.g., nitrides, such as TiN, and silicides, such as $WSi_2$, $MoSi_2$, $TiSi_2$, and $TaSi_2$) containing the above metal element; semiconductors, such as silicon (Si); carbon thin films of diamond or the like; and conductive metal oxides, such as ITO (indium-tin oxide), indium oxide, and zinc oxide. Examples of methods for forming the electrode include physical vapor deposition processes (PVD processes), such as vacuum vapor deposition processes, e.g., an electron beam deposition process and a hot filament deposition process, a sputtering process, an ion plating process, and a laser ablation process; various chemical vapor deposition processes (CVD processes); a screen printing process; an ink-jet printing process; a metal mask printing process; plating processes (such as an electroplating process and an electroless plating process); a lift-off process; and a sol-gel process, and combinations of any of the above processes and an etching process. Appropriate selection of the method for forming the electrode enables direct formation of the patterned strip-form first electrode, second electrode, cathode electrode, gate electrode, or focusing electrode.

In the Spindt-type field emitter element, examples of materials constituting the electron emitter may include at least one material selected from the group consisting of molybdenum, a molybdenum alloy, tungsten, a tungsten alloy, titanium, a titanium alloy, niobium, a niobium alloy, tantalum, a tantalum alloy, chromium, a chromium alloy, and silicon containing an impurity (polysilicon or amorphous silicon). The electron emitter in the Spindt-type field emitter element can be formed by a vacuum vapor deposition process or, e.g., a sputtering process or a CVD process.

In the flattened-type field emitter element, it is preferred that the material constituting the electron emitter has a work function $\Phi$ smaller than that of the material constituting the cathode electrode, and the material may be selected depending on the work function of the material constituting the cathode electrode, the potential difference between the gate electrode and the cathode electrode, the required emission current density, or the like. Alternatively, the material constituting the electron emitter may be appropriately selected from materials having a secondary electron gain $\delta$ larger than the secondary electron gain $\delta$ of the conductor constituting the cathode electrode. In the flattened-type field emitter element, especially preferred examples of the materials constituting the electron emitter include carbon, specifically, amorphous diamond, graphite, carbon nanotube structures (carbon nanotubes and/or graphite nanofibers), ZnO whisker, MgO whisker, $SnO_2$ whisker, MnO whisker, $Y_2O_3$ whisker, NiO whisker, ITO whisker, $In_2O_3$ whisker, and $Al_2O_3$ whisker. The material constituting the electron emitter may not have conductivity.

The flat form of the first opening (opening formed in the gate electrode) or second opening (opening formed in the insulating layer), that is, the form obtained by cutting the opening along a virtual plane parallel to the support surface, can be an arbitrary form, such as a circular form, an elliptical form, a rectangular form, a polygonal form, a rounded rectangular form, or a rounded polygonal form. The first opening can be formed by, for example, anisotropic etching, isotropic etching, or a combination of anisotropic etching and isotropic etching, and alternatively, depending on the method of forming the gate electrode, the first opening can be directly formed. The second opening can be formed by, for example, anisotropic etching, isotropic etching, or a combination of anisotropic etching and isotropic etching. The third opening in the focusing electrode and the interlayer dielectric layer can be formed by a similar method.

In the field emitter element, depending on the structure of the field emitter element, one opening may have one electron emitter or a plurality of electron emitters. Alternatively, one or a plurality of electron emitters may be present in one second opening, formed in the insulating layer, communicating with a plurality of first openings formed in the gate electrode.

In the field emitter element, a resistance thin film may be formed between the cathode electrode and the electron emitter. By virtue of the resistance thin film, the action of the field emitter element can be stabilized, and the electron emission properties can be uniform. Examples of materials constituting the resistance thin film include carbon resistance materials, such as silicon carbide (SiC) and SiCN; SiN; semiconductor resistance materials, such as amorphous silicon; and refractory metal oxides such as ruthenium oxide ($RuO_2$), tantalum oxide and refractory metal nitrides, such as tantalum nitride. Examples of methods for forming the resistance thin film include a sputtering process, a CVD process, and a screen printing process. The electric resistance per electron emitter may be generally $1\times10^6$ to $1\times10^{11}\Omega$, preferably several tens $G\Omega$.

As a material constituting the insulating layer or interlayer dielectric layer, $SiO_2$ materials, such as $SiO_2$, BPSG, PSG, BSG, AsSG, PbSG, SiON, SOG (spin on glass), low melting-point glass, and a glass paste; SiN materials; and insulating resins, such as polyimide, can be used individually or in combination. In forming the insulating layer or the interlayer dielectric layer, a known process, such as a CVD process, a coating process, a sputtering process, or a screen printing process, can be used.

In the flat-type display device, examples of constructions of the anode electrode and fluorescent regions include: (1) a construction such that the anode electrode is formed on a substrate and the fluorescent regions are formed on the anode electrode; and (2) a construction such that the fluorescent regions are formed on a substrate and the anode electrode is formed on the fluorescent regions. In the construction (1), a so-called metal back film electrically connected to the anode electrode may be formed on the fluorescent regions. In the construction (2), a metal back film may be formed on the anode electrode. The anode electrode can serve as a metal back film.

The anode electrode may be composed of either a single anode electrode as a whole or a plurality of anode electrode units. In the latter, it is preferred that one anode electrode unit is electrically connected to another anode electrode unit through an anode electrode resistance layer. Examples of materials constituting the anode electrode resistance layer include carbon materials, such as carbon, silicon carbide (SiC), and SiCN; SiN materials; refractory metal oxides and refractory metal nitrides, such as ruthenium oxide ($RuO_2$), tantalum oxide, tantalum nitride, chromium oxide, and titanium oxide; semiconductor materials, such as amorphous silicon; and ITO. The use of a plurality of films in combination in the anode electrode resistance layer, for example, the use of a carbon thin film having a lower resistance stacked on an SiC resistance film can achieve a stable, desired sheet resistance. The anode electrode resistance layer may have a sheet resistance of, for example, $1\times10^{-1}$ to $1\times10^{10}\ \Omega/\square$, preferably $1\times10^3$ to $1\times10^8\ \Omega/\square$. The number (UN) of the anode electrode units may be 2 or more. For example, when the total number of rows of the fluorescent regions arrayed in a straight line is un, UN=un, or un=u·(UN) (where u is an integer of 2 or more, preferably $10\leqq u\leqq100$, further preferably $20\leqq u\leqq50$), or UN may be a value obtained by adding one to the number of spacers disposed at predetermined intervals, a value equal to the number of pixels or subpixels, or a value obtained by dividing the number of pixels or subpixels by an integer. The sizes of the individual anode electrode units may be either the same irrespective of the positions of the anode electrode units or different depending on the positions of the anode electrode units. The anode electrode resistance layer may be formed on the single anode electrode as a whole. Instead of the anode electrode formed on the almost entire effective region, individual anode electrode units each having a smaller area are formed as mentioned above, reducing the electrostatic capacity between the anode electrode unit and the electron emitter area, so that the occurrence of discharge can be suppressed and hence the anode electrode or electron emitter area can be effectively prevented from suffering a damage due to discharge.

In a case where the anode electrode is composed of anode electrode units and a barrier (mentioned below) is formed, the anode electrode units can be formed over each fluorescent region and the sidewall of the barrier. The anode electrode units may be formed over each fluorescent region and part of the sidewall of the barrier.

The anode electrode (including anode electrode units) may be formed using a conductor layer. Examples of methods for forming the conductor layer include various PVD processes, such as vacuum deposition processes, e.g., an electron beam deposition process and a hot filament deposition process, a sputtering process, an ion plating process, and a laser ablation process; various CVD processes; a screen printing process; a metal mask printing process; a lift-off process; and a sol-gel process. Specifically, the anode electrode can be formed by forming a conductor layer and patterning the conductor layer in accordance with a lithography technique and an etching technique. Alternatively, the anode electrode can be obtained by forming a conductor layer through a mask or screen having a pattern of the anode electrode by a PVD process or a screen printing process. The anode electrode resistance layer can be formed by a method similar or analogous to the method for forming the anode electrode. Specifically, the anode electrode resistance layer may be formed from a resistance material and patterned in accordance with a lithography technique and an etching technique, or the anode electrode resistance layer can be obtained by processing a resistance material through a mask or a screen having a pattern of the anode electrode resistance layer by a PVD process or a screen printing process. The average thickness, or the average thickness of the anode electrode on the top surface of the barrier in a case where a barrier is formed as mentioned below, of the anode electrode on the substrate, or at the upper portion of the substrate, may be, for example, $3\times10^{-8}$ m (30 nm) to $5\times10^{-7}$ m (0.5 μm), preferably $5\times10^{-8}$ m (50 nm) to $3\times10^{-7}$ m (0.3 μm)

Examples of materials constituting the anode electrode include metals, such as aluminum (Al), molybdenum (Mo), chromium (Cr), tungsten (W), niobium (Nb), tantalum (Ta), gold (Au), silver (Ag), titanium (Ti), cobalt (Co), zirconium (Zr), iron (Fe), platinum (Pt), and zinc (Zn); alloys or compounds (e.g., nitrides, such as TiN, and silicides, such as $WSi_2$, $MoSi_2$, $TiSi_2$, and $TaSi_2$) containing the above metal element; semiconductors, such as silicon (Si); carbon thin films of diamond or the like; and conductive metal oxides, such as ITO (indium-tin oxide), indium oxide, and zinc oxide. In a case of forming an anode electrode resistance layer, it is preferred that the anode electrode is formed from a conductor which does not change the resistance of the anode electrode resistance layer. For example, when the anode electrode resistance layer is composed of silicon carbide (SiC), it is preferred that the anode electrode is formed from molybdenum (Mo).

The fluorescent regions may be individually comprised of either fluorescent particles of single color or fluorescent particles of three primary colors. The array form of the fluorescent regions is, for example, dotted. Specifically, when the flat-type display device makes color display, examples of array forms of the fluorescent regions include a delta array, a striped array, a diagonal array, and a rectangle array. Specifically, one row of the fluorescent regions arrayed in a straight line may be composed of a row occupied only by red light-emitting fluorescent regions, a row occupied only by green light-emitting fluorescent regions, or a row occupied only by blue light-emitting fluorescent regions. Alternatively, the row may be composed of a row comprising red light-emitting fluorescent regions, green light-emitting fluorescent regions, and blue light-emitting fluorescent regions, which are successively arranged. The fluorescent region is defined as a fluorescent region producing one luminescent spot on the anode panel. One pixel is composed of an assembly of one red light-emitting fluorescent region, one green light-emitting fluorescent region, and one blue light-emitting fluorescent region, and one subpixel is composed of one fluorescent region (one red light-emitting fluorescent region, one green light-emitting fluorescent region, or one blue light-emitting fluorescent region). Gaps between the adjacent fluorescent regions may be plugged with a light absorbing layer (black matrix) for improving the contrast.

The fluorescent regions can be formed by a method in which, using a luminescent crystal particle composition prepared from luminescent crystal particles, for example, a photosensitive, red luminescent crystal particle composition (red fluorescent slurry) is applied to the entire surface, and exposed and developed to form a red light-emitting fluorescent region, and then a photosensitive, green luminescent crystal particle composition (green fluorescent slurry) is applied to the entire surface, and exposed and developed to form a green light-emitting fluorescent region, and further a photosensitive, blue luminescent crystal particle composition (blue fluorescent slurry) is applied to the entire surface, and exposed and developed to form a blue light-emitting fluorescent region. Alternatively, each fluorescent region may be formed by a method in which a red light-emitting fluorescent paste, a green light-emitting fluorescent paste, and a blue light-emitting fluorescent paste are successively applied and then the individual fluorescent paste applied regions are successively exposed and developed. Alternatively, each fluorescent region may be formed by a screen printing process, an ink-jet process, a floating knife coating process, a sedimentation coating process, a fluorescent film transfer process, or the like. With respect to the average thickness of the fluorescent regions on the substrate, there is no particular limitation, but it is desired that the average thickness is 3 μm to 20 μm, preferably 5 μm to 10 μm. The fluorescent material constituting the luminescent crystal particles can be appropriately selected from known fluorescent materials. In color display, preferred is a combination of fluorescent materials such that the materials have colors close to three primary colors having the color purity prescribed by NTSC in which the three primary colors mixed have excellent white balance and the three primary colors individually have substantially the same and short afterglow time.

It is preferred that a light absorbing layer for absorbing light from the fluorescent regions is formed between the adjacent fluorescent regions or between the barrier and the substrate from the viewpoint of improving the contrast of the display image. The light absorbing layer serves as a so-called black matrix. As a material constituting the light absorbing layer, a material capable of absorbing 90% or more of light from the fluorescent regions is preferably selected. Examples of the materials include carbon, metal thin films (e.g., chromium, nickel, aluminum, molybdenum, and alloys thereof), metal oxides (e.g., chromium oxide), metal nitrides (e.g., chromium nitride), heat-resistant organic resins, glass pastes, and glass pastes containing a black pigment or conductive particles of silver or the like, and specific examples include photosensitive polyimide resins, chromium oxide, and a chromium oxide/chromium stacked film. In the chromium oxide/chromium stacked film, the chromium film is in contact with the substrate. The light absorbing layer can be formed by a method appropriately selected depending on the material used, for example, a combination of a vacuum vapor deposition process or a sputtering process and an etching process, a combination of a vacuum vapor deposition process, a sputtering process, or a spin coating process and a lift-off process, a screen printing process, or a lithography technique.

It is preferred to form a barrier for preventing the electrons bouncing off the fluorescent regions or the secondary electrons emitted from the fluorescent regions, i.e., so-called backscattering electrons from entering other fluorescent regions to cause so-called optical cross talk (color mixing).

Examples of methods for forming the barrier include a screen printing process, a dry film process, a photosensitive process, a casting process, and a sandblasting forming process. The screen printing process is a method in which a barrier-forming material is put on a screen having openings formed in portions corresponding to the positions where barriers should be formed, and the material is allowed to pass through the openings of the screen using a squeegee to form a barrier-forming material layer on a substrate, followed by calcination of the barrier-forming material layer. The dry film process is a method in which a photosensitive film is laminated on a substrate, and portions of the photosensitive film where barriers will be formed are removed by exposure and development, and openings resulting from the removal of the film are plugged with a barrier-forming material, followed by calcination. The photosensitive film is burned and removed by calcination, and the barrier-forming material in the openings remains as barriers. The photosensitive process is a method in which a barrier-forming material layer having photosensitivity is formed on a substrate, and the barrier-forming material layer is patterned by exposure and development, followed by calcination (curing). The casting process is a method in which a barrier-forming material composed of an organic material or inorganic material in the form of a paste is casted from a cast onto a substrate to form a barrier-forming material layer, followed by calcination of the barrier-forming material layer. The sandblasting forming process is a method in which a barrier-forming material layer is formed on a substrate by, for example, a screen printing or a metal mask printing process, or using a roll coater, a doctor blade, or a nozzle injection coater, and dried and then, portions of the barrier-forming material layer where barriers will be formed are covered with a mask layer, and then the exposed portions of the barrier-forming material layer are removed by a sandblasting method. The barriers are formed and then, the barriers may be polished to planarize the top surfaces of the barriers.

Examples of flat forms of the portion of the barrier surrounding each fluorescent region, which corresponds to the inner contour of the image from the sidewall of the barrier, which is a kind of opening region, include a rectangular form, a circular form, an elliptical form, an oblong form, a triangular form, a polygonal form having five sides or more, a rounded triangular form, a rounded rectangular form, and a rounded polygonal form. These flat forms of the opening regions are arrayed in a two-dimensional matrix form to form a barrier in a lattice-like pattern. This array in a two-dimensional matrix form may be, for example, either a form of parallel crosses or a zigzag form.

Examples of materials for forming the barrier include photosensitive polyimide resins, and lead glass colored black with a metal oxide, such as cobalt oxide, $SiO_2$, and low melting-point glass pastes. On the surface (top surface and sidewall) of the barrier may be formed a protective layer (comprised of, e.g., $SiO_2$, SiON, or AlN) for preventing an electron beam from colliding with the barrier to release gas from the barrier.

Joining the cathode panel and the anode panel together at their edges may be conducted either using a joint member composed of a bonding layer or using a joint member formed of a frame composed of an insulating rigid material, such as glass or ceramic, having a rod shape or a frame shape, and a bonding layer. In a case of using a joint member formed of a frame and a bonding layer, the distance between the cathode panel and the anode panel can be long due to appropriate selection of the height of the frame, as compared to that obtained when using a joint member composed only of a bonding layer. As a material constituting the bonding layer, frit glass, such as $B_2O_3$—PbO frit glass or $SiO_2$—$B_2O_3$—PbO frit glass, is generally used, but a so-called low melting-point metal material having a melting point of about 120 to 400° C. may be used. Examples of the low melting-point metal materials include In (indium; melting point: 157° C.); indium-gold low melting-point alloys; tin (Sn) high-temperature solder, such as $Sn_{80}Ag_{20}$ (melting point: 220° C. to 370° C.) and $Sn_{95}Cu_5$ (melting point: 227° C. to 370° C.); lead (Pb) high-temperature solder, such as $Pb_{97.5}Ag_{2.5}$ (melting point: 304° C.), $Pb_{94.5}Ag_{5.5}$ (melting point: 304° C. to 365° C.), and $Pb_{97.5}Ag_{1.5}Sn_{1.0}$ (melting point: 309° C.); zinc (Zn) high-temperature solder, such as $Zn_{95}Al_5$ (melting point: 380° C.); tin-lead standard solder, such as $Sn_5Pb_{95}$ (melting point: 300° C. to 314° C.) and $Sn_2Pb_{98}$ (melting point: 316° C. to 322° C.); and brazing materials, such as $Au_{88}Ga_{12}$ (melting point: 381° C.) (where each subscript indicates atomic %)

Three members of the cathode panel, the anode panel, and the joint member may be joined together either in a way such that the three members are joined together at the same time or in a way such that the cathode panel or anode panel and the joint member are first joined together on the first stage and then the remaining cathode panel or anode panel and the joint member are joined on the second stage. If joining the three members together at the same time or the joining on the second stage is conducted in a high-vacuum atmosphere, a space between the cathode panel, the anode panel, and the joint member becomes a vacuum simultaneously with joining them. Alternatively, after joining the three members together, a space between the cathode panel, the anode panel, and the joint member can be evacuated to create a vacuum. In evacuating the space after the joining, the pressure in the atmosphere for the joining may be either atmospheric pressure or a reduced pressure, and gas constituting the atmosphere is preferably inert gas comprising nitrogen gas or gas of element belonging to Group 0 of the Periodic Table (e.g., Ar gas), and alternatively the evacuation can be performed in air.

The evacuating the space can be made through an exhaust tube called also tip pipe preliminarily connected to the cathode panel and/or anode panel. The exhaust tube is typically comprised of a glass tube, or a hollow tube made of a metal or an alloy having a low coefficient of thermal expansion (e.g., an iron (Fe) alloy containing 42% by weight of nickel (Ni), or an iron (Fe) alloy containing 42% by weight of nickel (Ni) and 6% by weight of chromium (Cr)), and is joined to the periphery of a through-hole formed in the cathode panel and/or anode panel in a non-effective region using the above-mentioned frit glass or low melting-point metal material, and cut and sealed by heat-fusion or contact bonding after the space has reached a predetermined degree of vacuum. If the whole of the flat-type display device is heated and then cooled before sealing the exhaust tube, the space can release residual gas, so that the residual gas can be advantageously removed from the space by evacuation.

Each spacer may be comprised of a plurality of spacer members. Specifically, the spacer in a line may be comprised of either a single spacer or a plurality of spacer members. In the latter, a plurality of spacer members are arranged on the axis of the spacer in a line. The spacer (including spacer members) can be formed from, for example, ceramic or glass. Examples of ceramics constituting the spacer include aluminum silicate compounds, such as mullite, aluminum oxides, such as alumina, barium titanate, lead titanate zirconate, zirconia (zirconium oxide), cordierite, barium borosilicate, iron silicate, glass ceramic materials, and the above materials containing titanium oxide, chromium oxide, magnesium oxide, iron oxide, vanadium oxide, or nickel oxide, and materials described in, e.g., Japanese Translation of PCT International Application (KOHYO) No. 2003-524280 can also be used. Examples of glass constituting the spacer include soda-lime glass. The spacer may be fixed by, for example, disposing it between a barrier and another barrier, or fixed by a spacer holder formed in the anode panel and/or cathode panel.

The spacer can be produced by, for example:

(a) adding a binder to ceramic powder and conduction imparting material powder as a dispersoid to prepare a slurry for green sheet;

(b) shaping the slurry for green sheet to obtain a green sheet; and then (c) calcining the green sheet.

The antistatic film mentioned below may be formed after cutting the calcined green sheet, or the antistatic film may be formed on the calcined green sheet before cutting the calcined green sheet.

As examples of materials constituting the ceramic powder as a dispersoid of the slurry for green sheet, there can be mentioned the above ceramics. The conduction imparting material as a dispersoid of the slurry for green sheet may not have conductivity in the slurry for green sheet. The conduction imparting material may be either a material that changes in chemical composition in calcining the green sheet or a material that does not change in chemical composition due to the calcination. Specifically, the conduction imparting material may be any material as long as the conduction imparting material which has been calcined in calcining the green sheet exhibits conductivity. Examples of the conduction imparting materials as a dispersoid of the slurry for green sheet include noble metals, such as gold and platinum; metal oxides, such as molybdenum oxide, niobium oxide, tungsten oxide, and nickel oxide; metal carbides, such as titanium carbide, tungsten carbide, and nickel carbide; metal salts, such as ammonium molybdate; and mixtures thereof. That is, the conduction imparting material may be either composed of a single material or composed of a plurality of materials. Examples of materials constituting the binder added to the slurry for green sheet include organic binder materials (such as acrylic emulsions, polyvinyl alcohol (PVA), and polyethylene glycol), and inorganic binder materials (e.g., water glass).

It is preferred that an antistatic film is formed on the surface of the spacer. It is preferred that the antistatic film is composed of a material having a coefficient of secondary electron emission close to 1, and, as a material constituting the antistatic film, a semi-metal, such as graphite, an oxide, a boride, a carbide, a sulfide, or a nitride can be used. Specific examples of the materials include semi-metals, such as graphite, and compounds containing a semi-metal element, such as $MoSe_2$; oxides, such as $CrO_x$, $CrAl_xO_y$, $Nd_2O_3$, $La_xBa_{2-x}CuO_4$, $La_xBa_{2-x}CuO_4$, and $La_xY_{1-x}CrO_3$; borides, such as $AlB_2$ and $TiB_2$; carbides, such as SiC; sulfides, such as $MoS_2$ and $WS_2$; and nitrides, such as BN, TiN, and AlN, and further, for example, materials described in Japanese Translation of PCT International Application (KOHYO) No. 2004-500688 and others can be used. The antistatic film may be composed of either a single material or a plurality of materials, and may be of either a single-layer structure or a multilayer structure. The antistatic film can be formed from a mixture of a first metal oxide and a second metal oxide. Examples of combinations of the first metal oxide and the second metal oxide include chromium oxide-titanium oxide, chromium oxide-indium oxide, manganese oxide-titanium oxide, manganese oxide-indium oxide, zinc oxide-titanium oxide, and zinc oxide-indium oxide. The antistatic film can be formed by a known method, such as a sputtering process, a vapor deposition process, or a CVD process. The antistatic film may be formed either directly on the sidewall portion of the spacer or on a primary coat for, e.g., improving the adhesion formed on the spacer.

DESCRIPTION OF THE EMBODIMENTS

Figure 1:
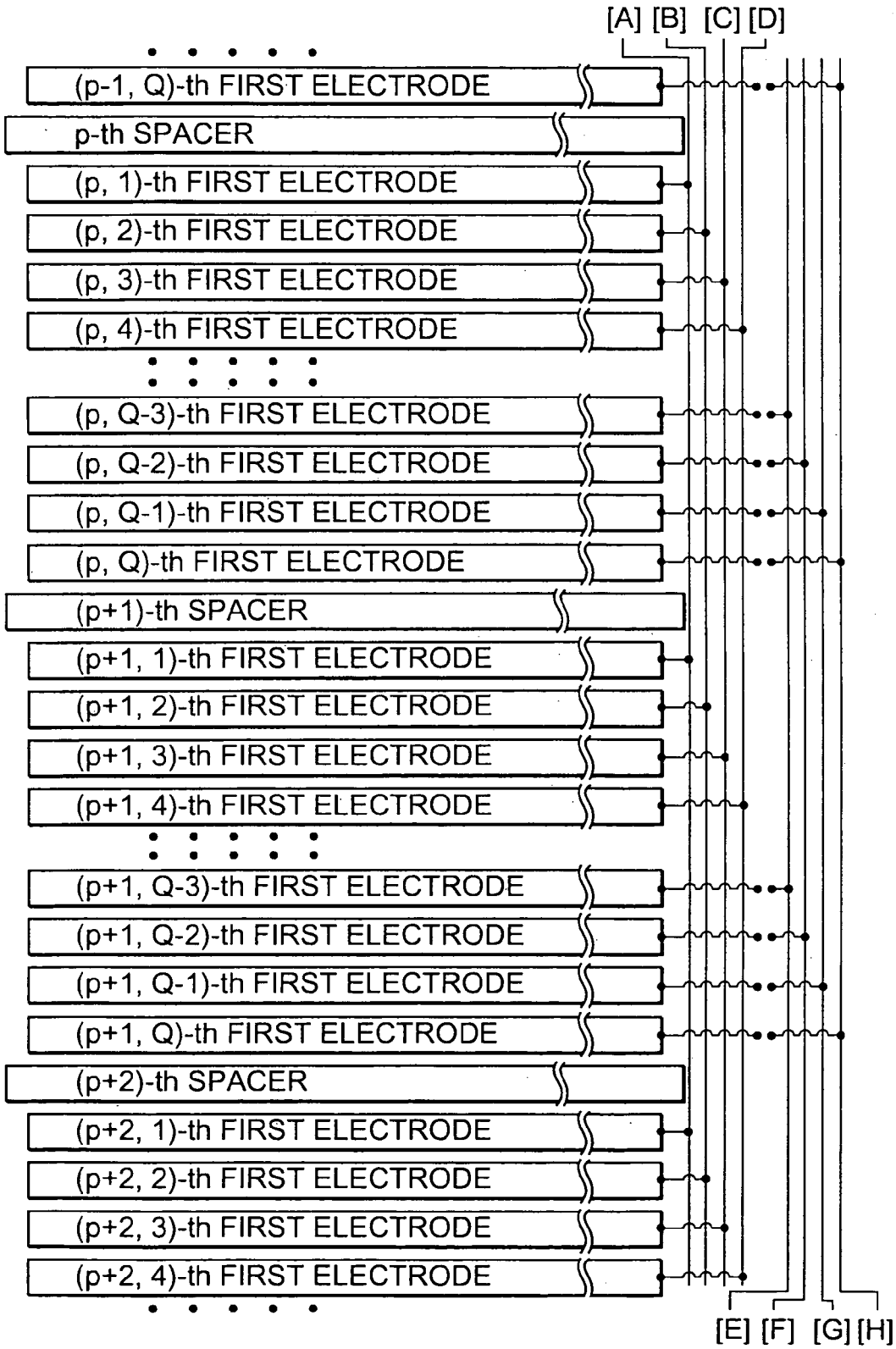
FIG. 1 is a diagram showing a state of application of a voltage to a first electrode in a method for driving a flat-type display device in Example 1, Example 2, or Example 4.

Hereinbelow, the present invention will be described with reference to the following Examples and the accompanying drawings, and the construction common to the flat-type display devices in Examples 1 to 9 is first briefly described below. The flat-type display device in each of Examples 1 to 9 is a cold cathode field emission display device (hereinafter, referred to simply as "display device"). In the display device in each of Examples 1 to 9, the strip-form first electrode (e.g., scanning electrode) extending in a first direction is composed of a gate electrode 13, and the strip-form second electrode (e.g., data electrode) extending in a second direction is composed of a cathode electrode 11.

The display device in each of Examples 1 to 9, as shown in FIGS. 6 to 11 of diagrammatic fragmentary end views of the display device along the second direction (see the Y direction shown in the figures), comprises:

(A) a cathode panel CP having M strip-form first electrodes (gate electrodes 13) extending in a first direction (see the X direction shown in the figures) and N strip-form second electrodes (cathode electrodes 11) extending in a second direction (see the Y direction shown in the figures) different from the first direction, and having N×M electron emitter areas EA composed of overlap regions between the first electrodes (gate electrodes 13) and the second electrodes (cathode electrodes 11); and (B) an anode panel AP having a fluorescent region 22 and an anode electrode 24, in which the cathode panel CP and the anode panel AP are joined together at their edges through a joint member 26.

Figure 19:
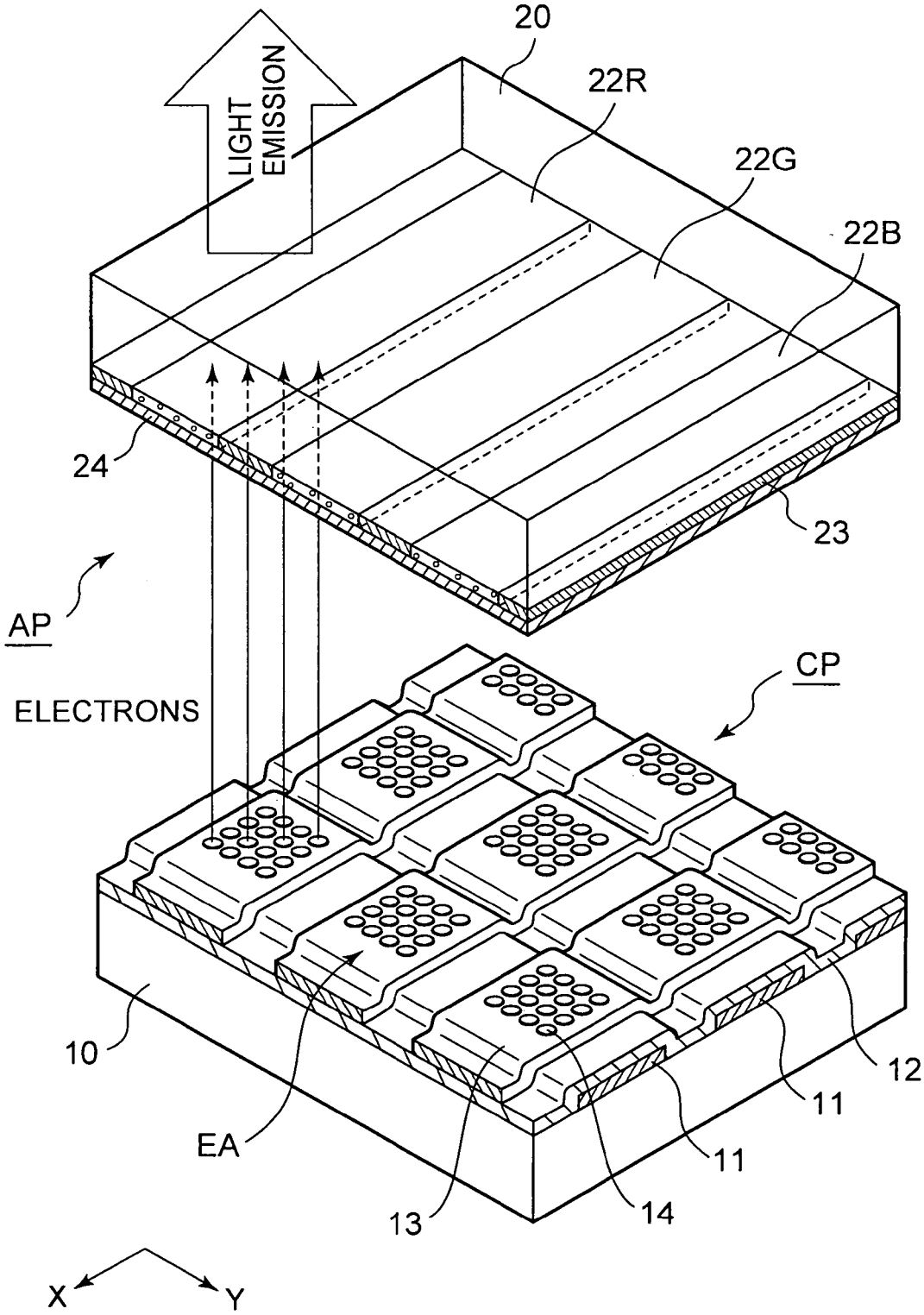
FIG. 19 is a partial, diagrammatic exploded perspective view of a cathode panel and an anode panel in a cold cathode field emission display device.
Figure 20A:
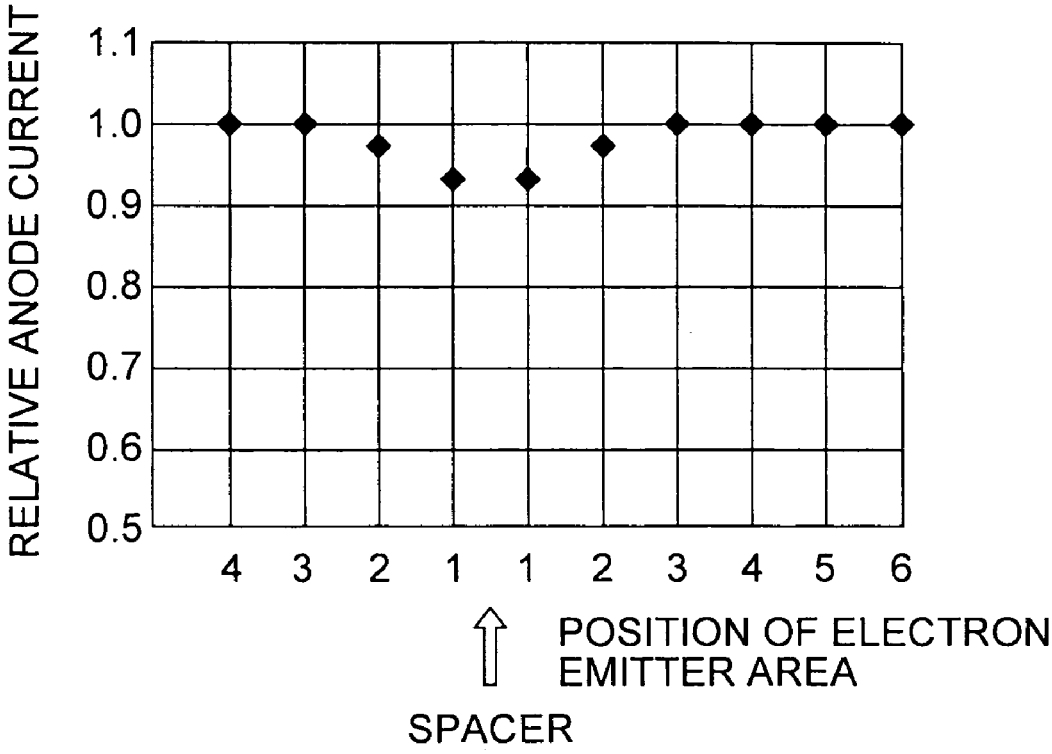
FIG. 20A is a graph diagrammatically showing an anode current flowing between the electron emitter area and the anode electrode due to the electrons emitted from the electron emitter areas.
Figure 20B:
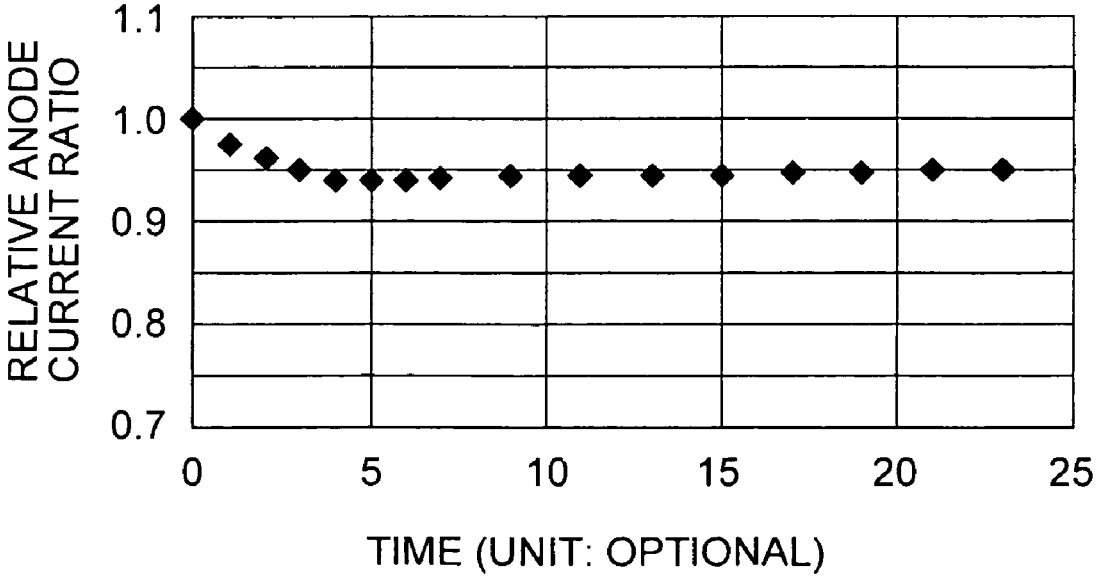
FIG. 20B is a graph diagrammatically showing a change with time in the conditions of electron emission from the electron emitter areas.

The display devices in Examples 1 to 9 individually have an effective region EF, and a non-effective region NE surrounding the effective region EF. The effective region EF is a display region at the substantial center having a practical function of the display device, i.e., display function, and the effective region EF is surrounded by the non-effective region NE in the form of a frame. A space between the cathode panel CP, the anode panel AP, and the joint member 26 is a vacuum (pressure: e.g., $10^{-3}$ Pa or less). A partial, diagrammatic exploded perspective view of the cathode panel CP and the anode panel AP separated from each other is basically similar to that shown in FIG. 19.

In Examples 1 to 9, a field emitter element constituting the electron emitter areas is formed of, for example, a Spindt-type field emitter element. The Spindt-type field emitter element includes:

(a) a cathode electrode (second electrode) 11 formed on a support 10;

(b) an insulating layer 12 formed on the support 10 and cathode electrode 11;

(c) a gate electrode (first electrode) 13 formed on the insulating layer 12;

(d) openings 14 (a first opening 14A formed in the gate electrode 13 and a second opening 14B formed in the insulating layer 12) formed in portions of the gate electrode 13 and the insulating layer 12 in an overlap portion where the cathode electrode 11 and the gate electrode 13 overlap, in which the cathode electrode 11 is exposed through the bottom of each opening; and (e) an electron emitter 15 formed on the cathode electrode 11 exposed through the bottom of each opening 14, and controlled in respect of electron emission by the application of a voltage to the cathode electrode 11 and gate electrode 13. The electron emitter 15 is conical.

Figure 18:
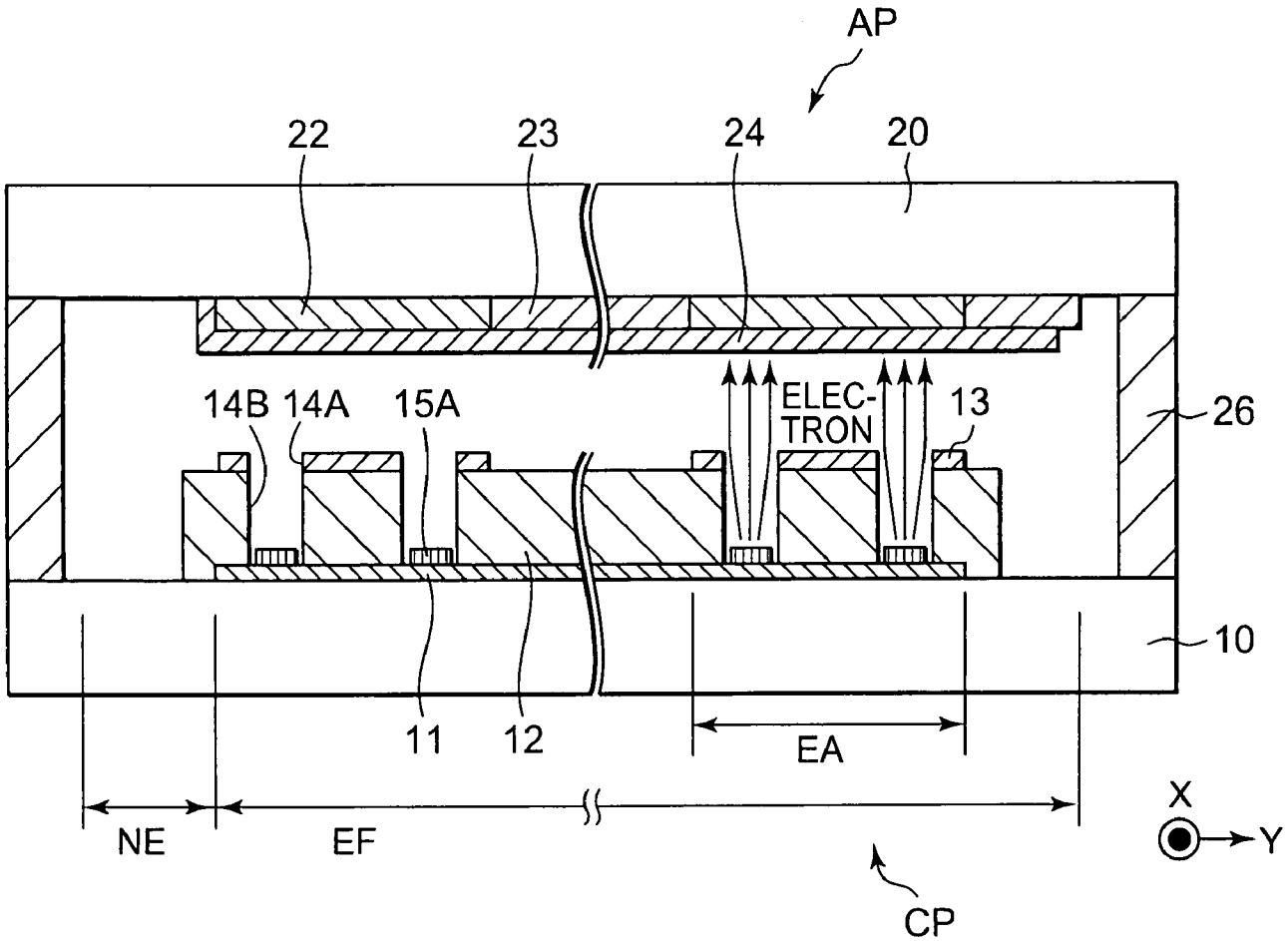
FIG. 18 is a conceptual fragmentary end view of a related art flat-type display device composed of a cold cathode field emission display device having a flat-type cold cathode field emitter element.

Alternatively, in Examples 1 to 9, the electron emitter element is formed of, for example, a flat-type field emitter element. Specifically, the flat-type field emitter element, as shown in FIG. 18, includes:

(a) a cathode electrode (second electrode) 11 formed on a support 10;

(b) an insulating layer 12 formed on the support 10 and cathode electrode 11;

(c) a gate electrode (first electrode) 13 formed on the insulating layer 12;

(d) openings 14 (a first opening 14A formed in the gate electrode 13 and a second opening 14B formed in the insulating layer 12) formed in portions of the gate electrode 13 and insulating layer 12 in an overlap portion where the cathode electrode 11 and the gate electrode 13 overlap, in which the cathode electrode 11 is exposed through the bottom of each opening; and (e) an electron emitter 15A formed on the cathode electrode 11 exposed through the bottom of each opening 14, and controlled in respect of electron emission by the application of a voltage to the cathode electrode 11 and gate electrode 13. The electron emitter 15A is composed of, for example, a number of carbon nanotubes, part of which are buried in the matrix.

In the cathode panel CP, the cathode electrode 11 is in the form of a strip extending in a second direction (see the Y direction shown in the figures), and the gate electrode 13 is in the form of a strip extending in a first direction (see the X direction shown in the figures) different from the second direction. The cathode electrode 11 and the gate electrode 13 are formed in strips in respective directions such that the images from the electrodes 11, 13 cross at a right angle. The electron emitter area EA corresponding to one subpixel has a plurality of field emitter elements. The electron emitter areas EA corresponding to one subpixel are arrayed in a two-dimensional matrix form in the effective region EF of the cathode panel CP.

Figure 9:
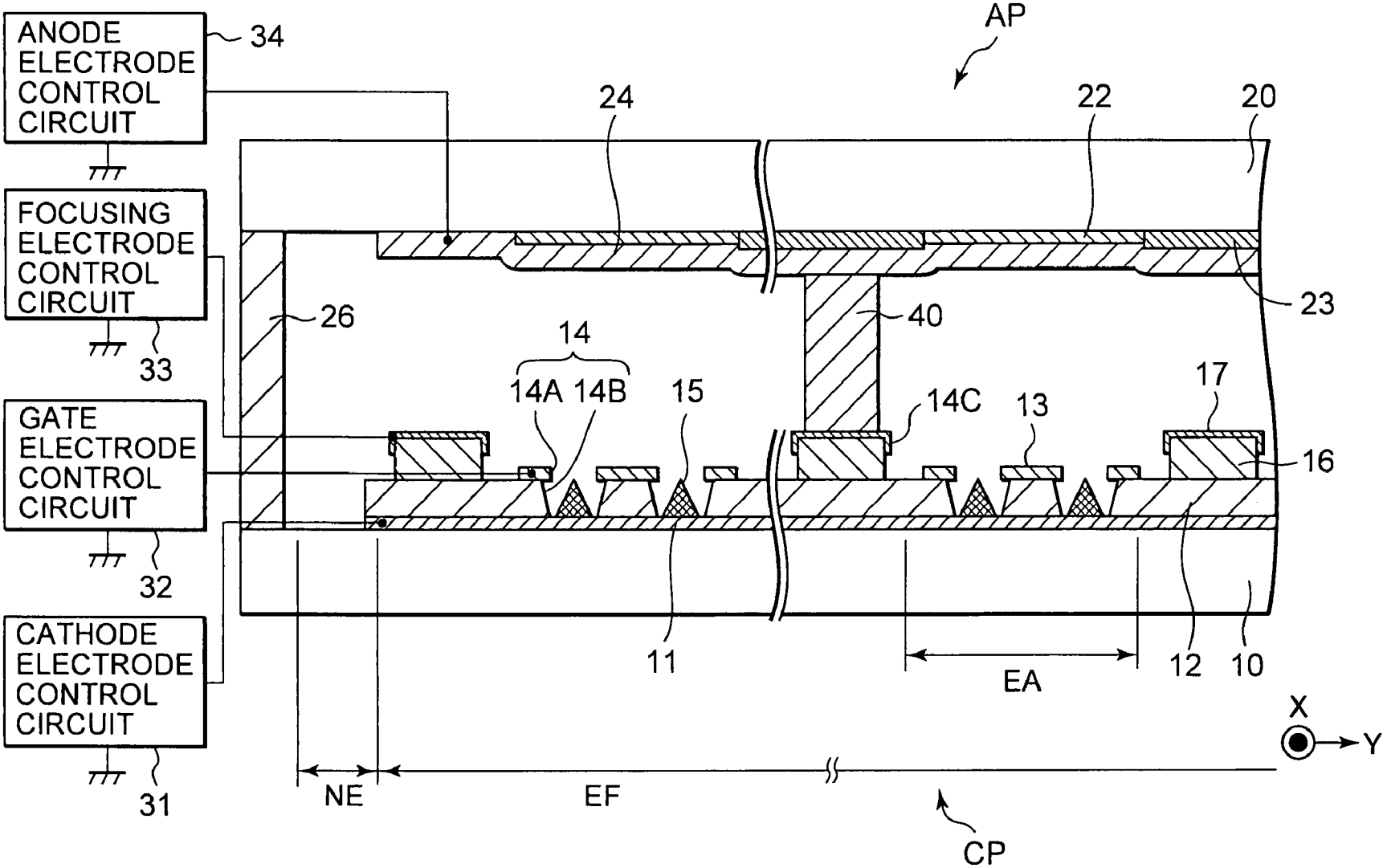
FIG. 9 is a fragmentary end view of the flat-type display device in Examples 1 to 9 composed of a cold cathode field emission display device having a Spindt-type cold cathode field emitter element having a focusing electrode.
Figure 10:
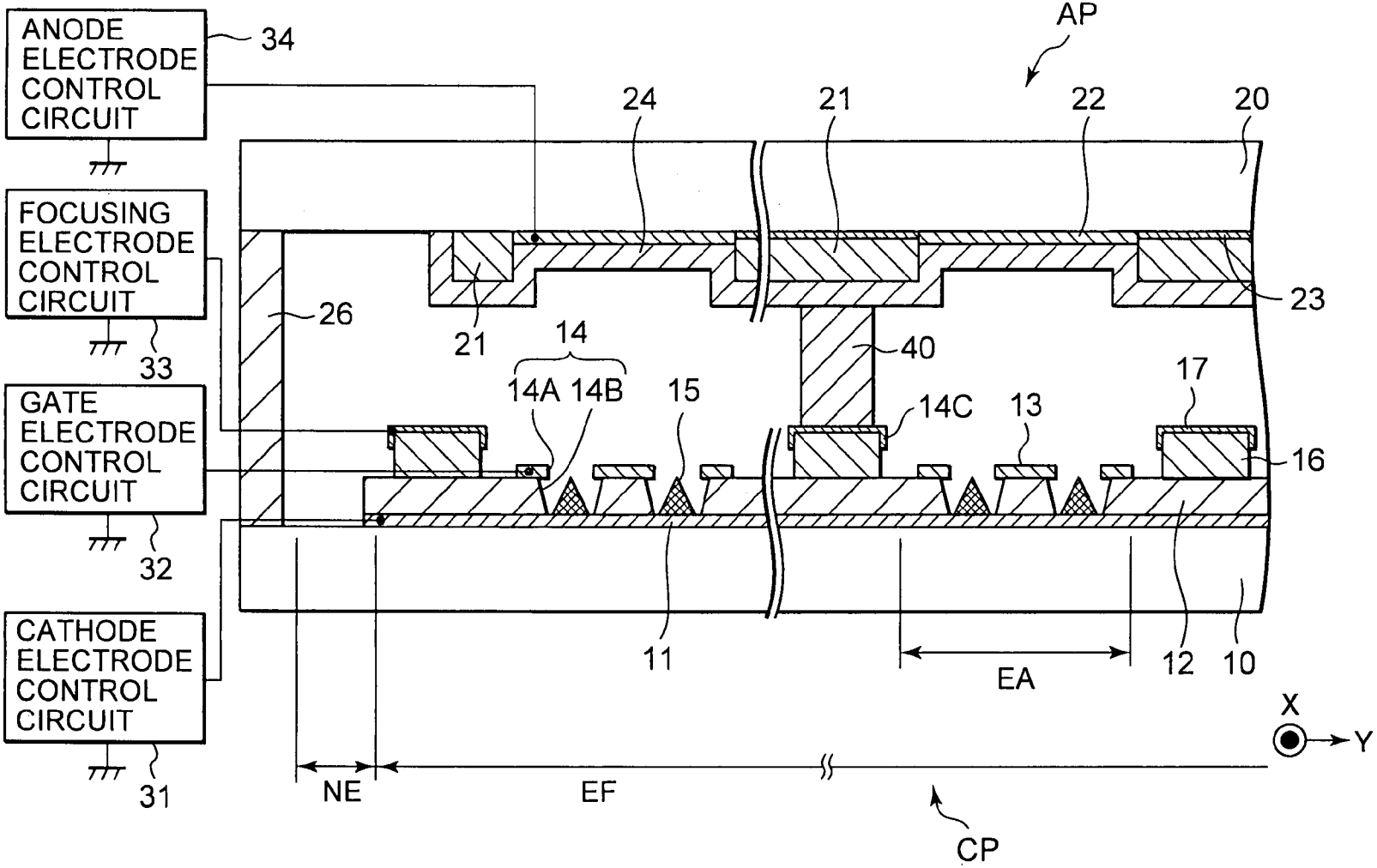
FIG. 10 is a fragmentary end view of the flat-type display device in Examples 1 to 9 composed of an example of variation on the cold cathode field emission display device having a Spindt-type cold cathode field emitter element having a focusing electrode.
Figure 11:
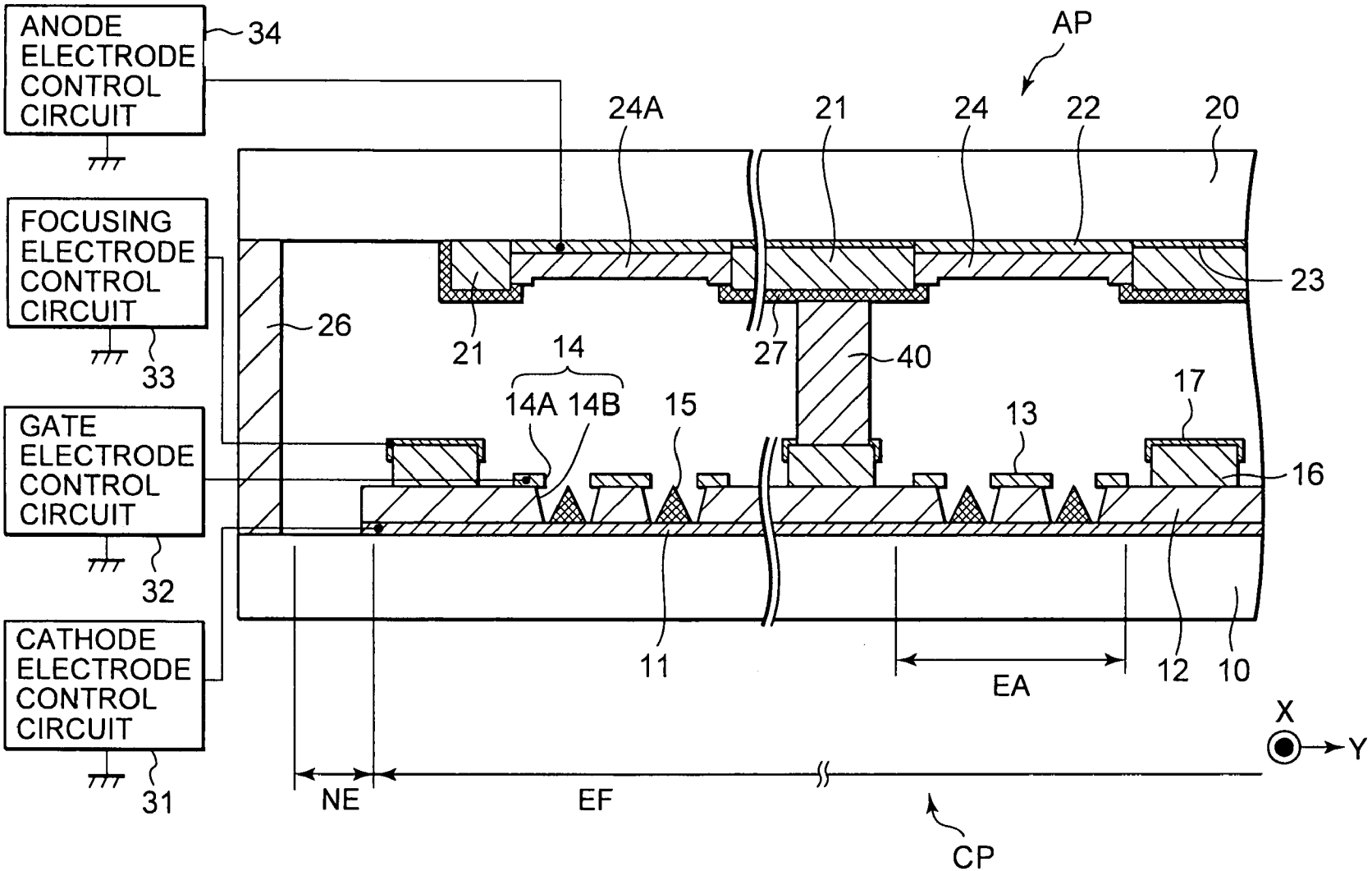
FIG. 11 is a fragmentary end view of the flat-type display device in Examples 1 to 9 comprised of another example of variation on the cold cathode field emission display device having a Spindt-type cold cathode field emitter element having a focusing electrode.
Figure 12:
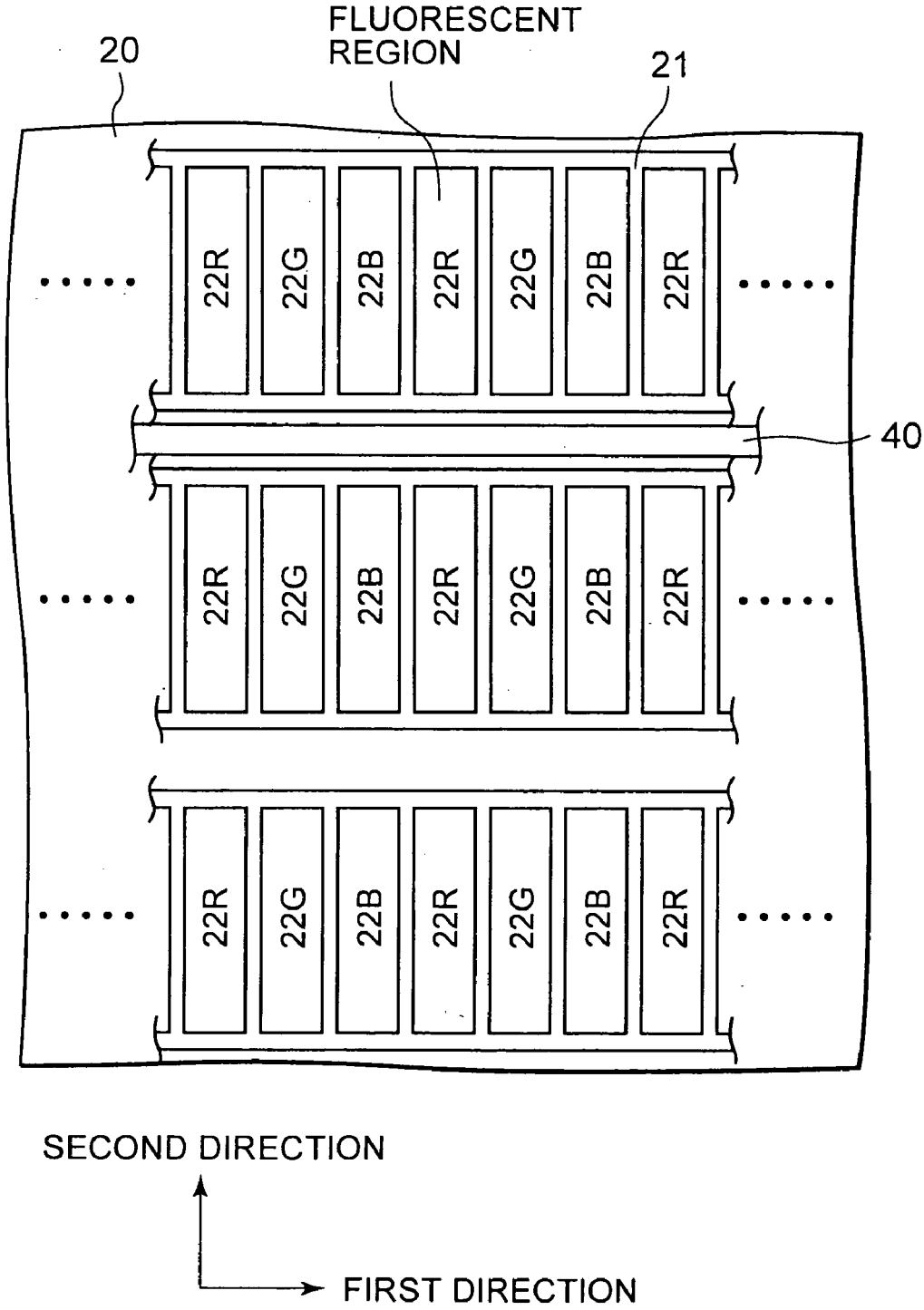
FIG. 12 is a view diagrammatically showing an arrangement of a barrier, a spacer, and fluorescent regions in an anode panel constituting the flat-type display device.

As shown in FIGS. 9 to 11, in some display devices, an interlayer dielectric layer 16 is formed on the insulating layer 12 and gate electrode 13, and a focusing electrode 17 is formed on the interlayer dielectric layer 16 so as to surround the electron emitter areas EA, thus offering a focusing effect common to the electron emitter areas EA. A third opening 14C is formed in the focusing electrode 17 and interlayer dielectric layer 16.

In the non-effective region NE of the cathode panel CP, a through-hole (not shown) for vacuum extraction is formed, and to the through-hole is fitted an exhaust tube (not shown) called also chip tube which is cut and sealed after the vacuum extraction.

Figure 6:
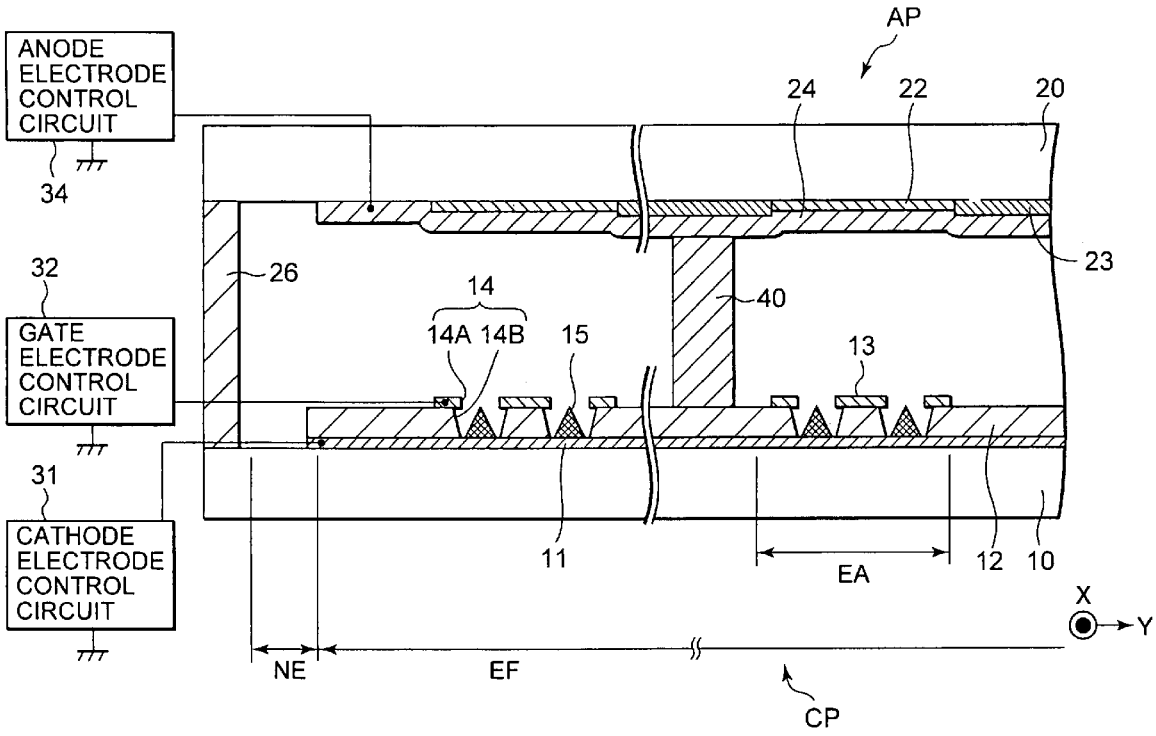
FIG. 6 is a fragmentary end view of a flat-type display device in Examples 1 to 9 composed of a cold cathode field emission display device having a Spindt-type cold cathode field emitter element.

In the display devices in Examples 1 to 9, as shown in FIG. 6 or FIG. 9, the anode panel AP is configured with a substrate 20, fluorescent regions 22 (in color display, red light-emitting fluorescent region 22R, green light-emitting fluorescent region 22G, and blue light-emitting fluorescent region 22B) formed on the substrate 20, and an anode electrode 24. On the substrate 20 between a fluorescent region 22 and another fluorescent region 22 is formed a light absorbing layer (black matrix) 23 for preventing the occurrence of color mixing in the display image, i.e., optical cross talk. The anode electrode 24 is composed of aluminum (Al) having a thickness of about 0.3 μm, and is in the form of a single thin sheet covering the effective region EF, and covers the fluorescent regions 22.

Figure 7:
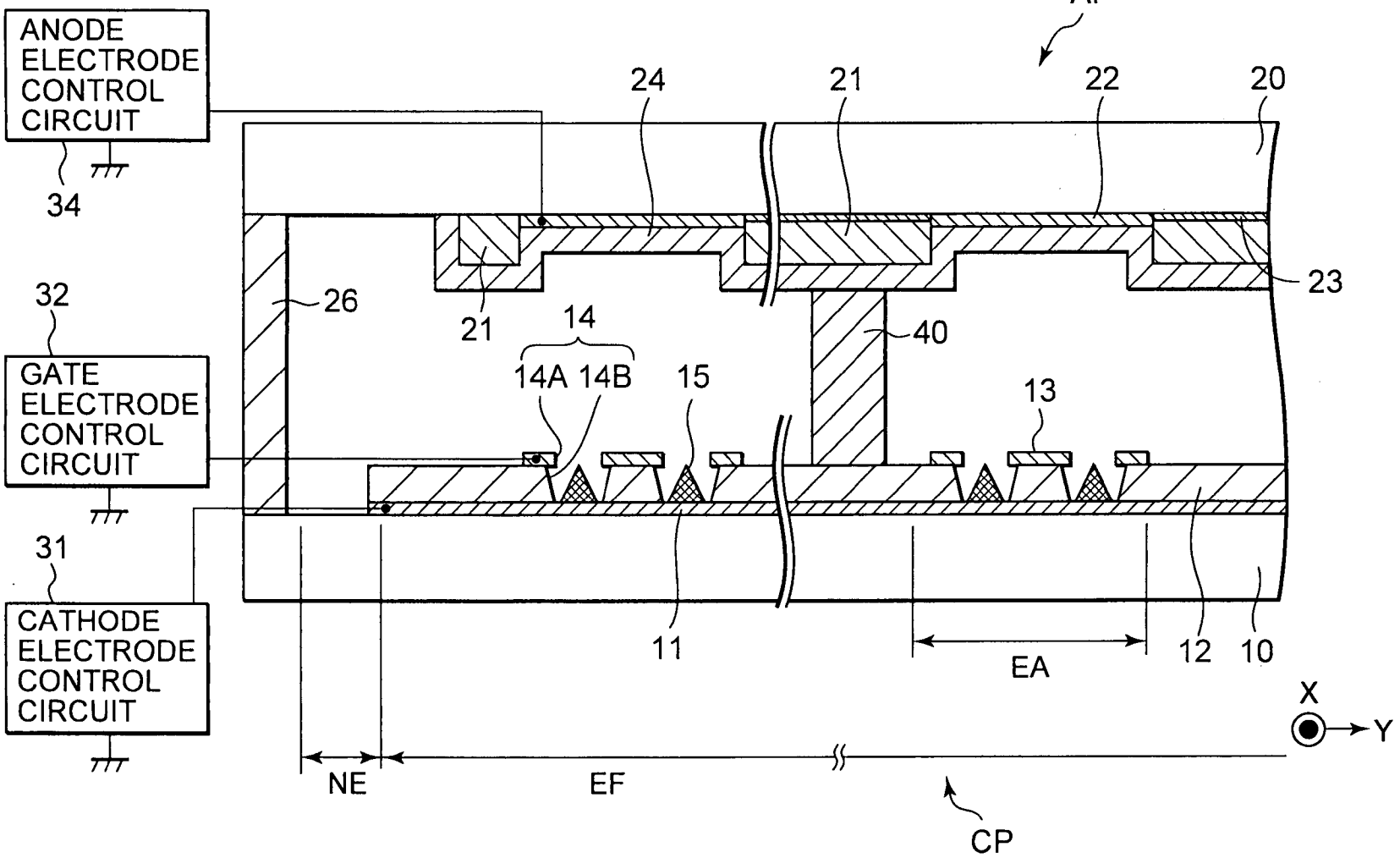
FIG. 7 is a fragmentary end view of the flat-type display device in Examples 1 to 9 composed of an example of variation on the cold cathode field emission display device having a Spindt-type cold cathode field emitter element.

Alternatively, in the display devices in Examples 1 to 9, as shown in FIG. 7 or FIG. 10, the anode panel AP may have a construction or structure in which a barrier 21 in a lattice-like pattern surrounding each fluorescent region 22 is formed on the substrate 20. One pixel is composed of the red light-emitting fluorescent region 22R, green light-emitting fluorescent region 22G, and blue light-emitting fluorescent region 22B, and one subpixel is composed of the fluorescent region 22. Each fluorescent region 22 is surrounded by the barrier 21. The flat form of a portion of the checkered barrier 21 surrounding each fluorescent region 22, which corresponds to the inner contour of the image from the sidewall of the barrier, which is a kind of opening region, is a rectangular form (oblong), and the flat forms (flat forms of the opening regions) are arrayed in a two-dimensional matrix form (more specifically, form of parallel crosses) to form the barrier 21 in a lattice-like pattern.

Figure 8:
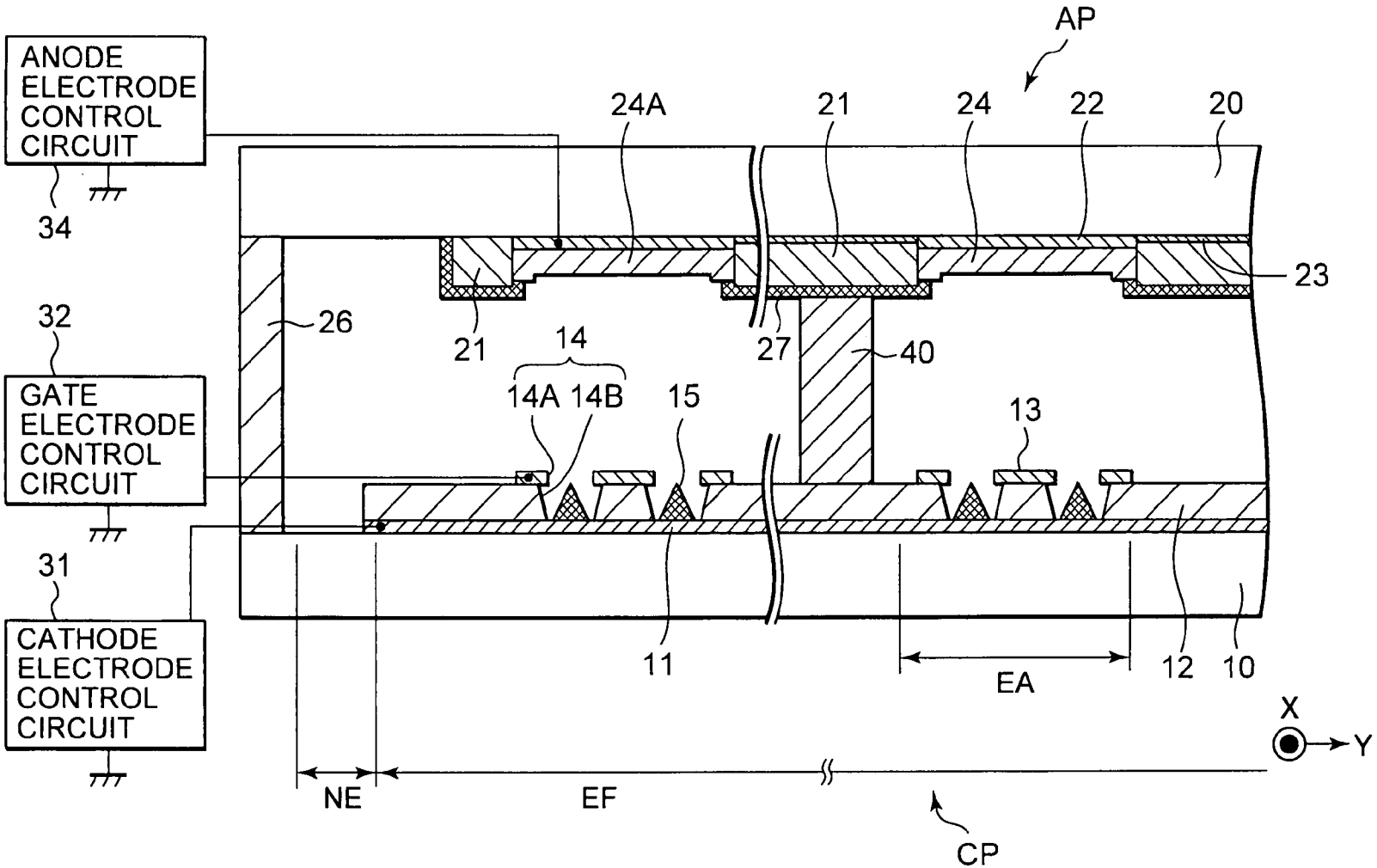
FIG. 8 is a fragmentary end view of the flat-type display device in Examples 1 to 9 composed of another example of variation on the cold cathode field emission display device having a Spindt-type cold cathode field emitter element.

Further alternatively, in the display devices in Examples 1 to 9, as shown in FIG. 8 or FIG. 11, the anode panel AP may have a construction or structure in which the anode electrode 24 covers each fluorescent region 22 and extends to the sidewall of the barrier 21, but the anode electrode 24 is not formed on the top surface of the barrier 21. That is, the anode electrode 24 is composed of a plurality (more specifically, corresponding to the number of subpixels) of anode electrode units 24A. The adjacent anode electrode units 24A are electrically connected to each other through an anode electrode resistance layer 27.

Figure 2:
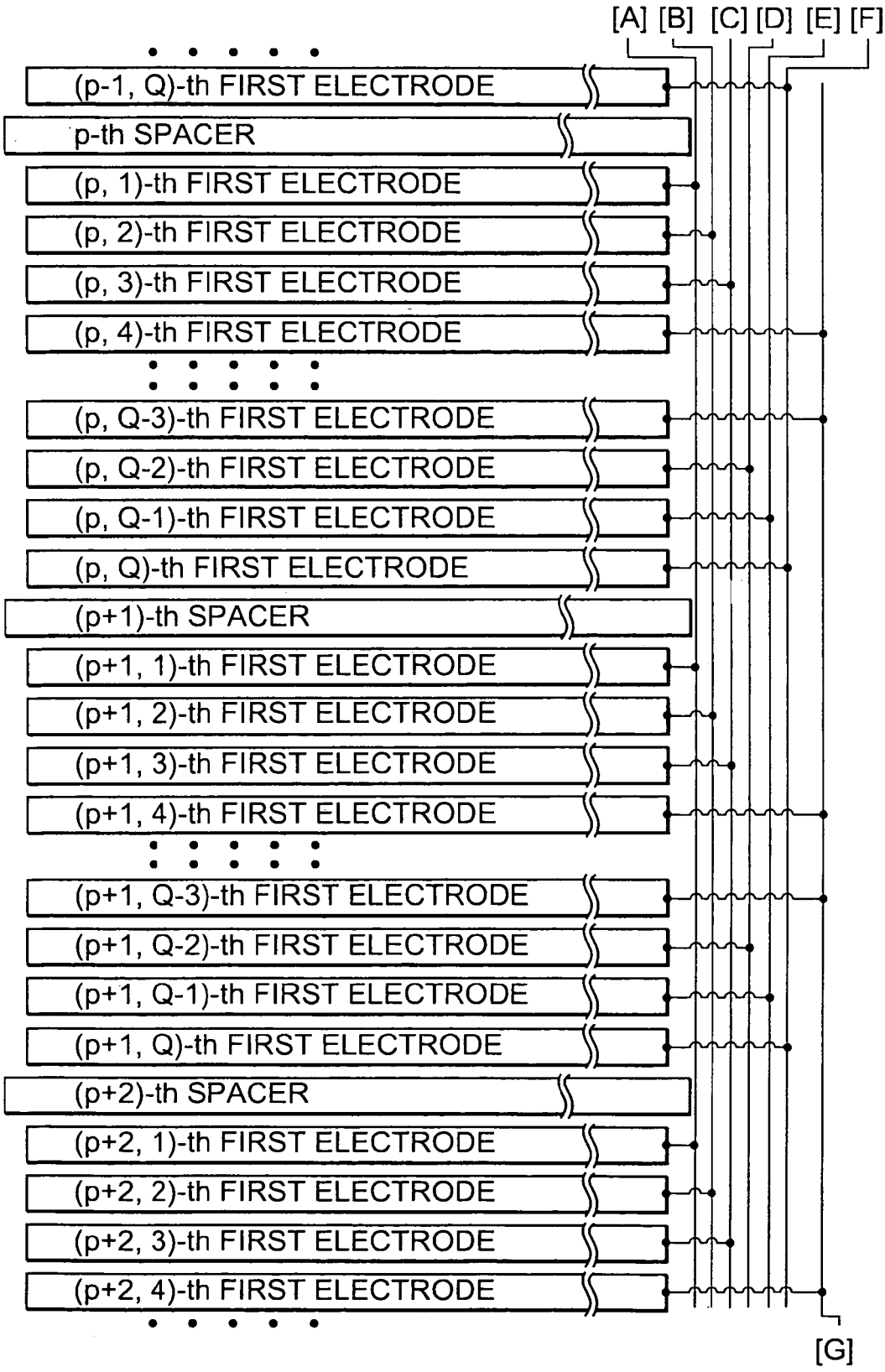
FIG. 2 is a diagram showing the state of application of a voltage to the first electrode in the method for driving a flat-type display device in Example 3.
Figure 13:
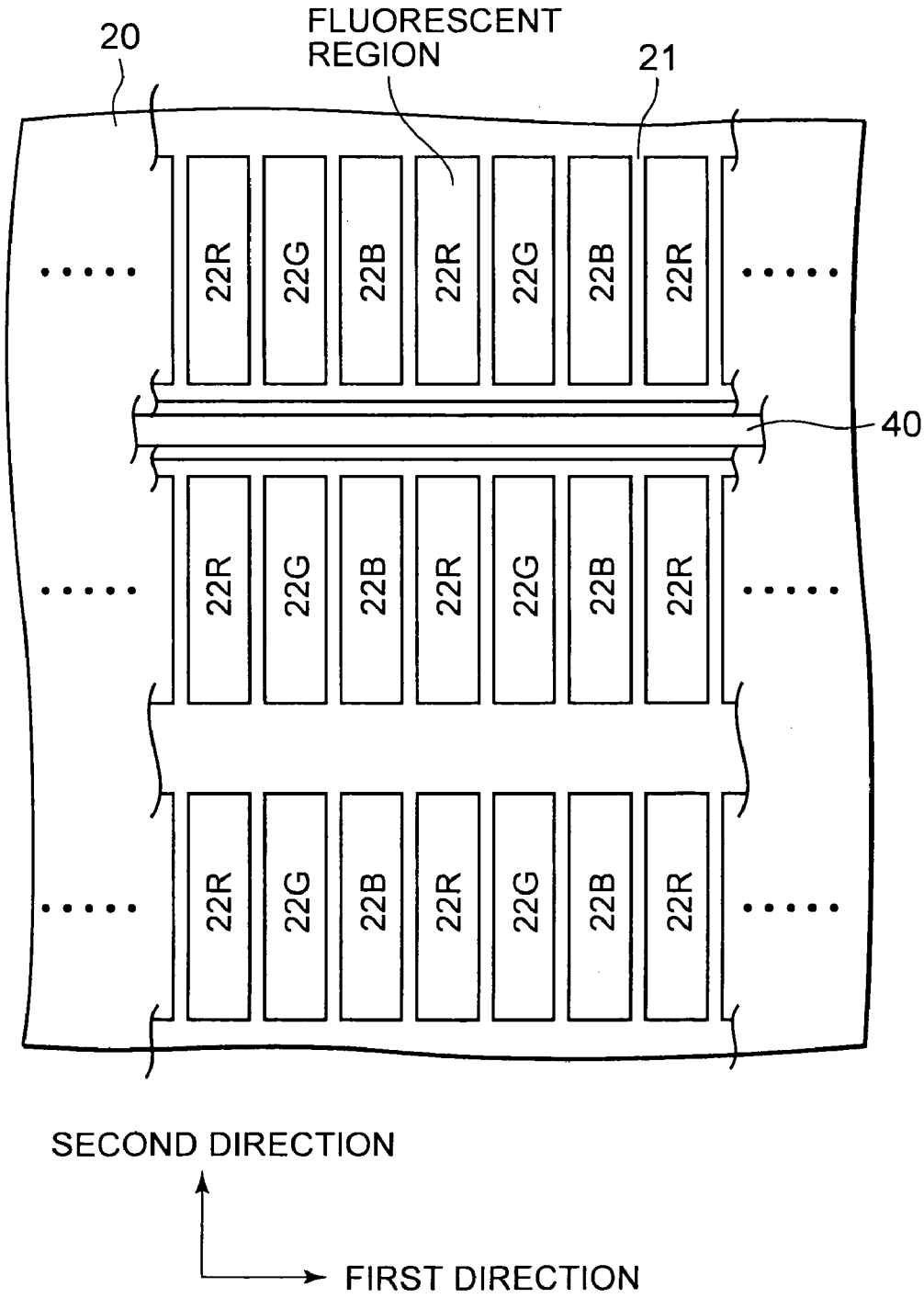
FIG. 13 is a view diagrammatically showing the arrangement of the barrier, spacer, and fluorescent regions in the anode panel constituting the flat-type display device.
Figure 14:
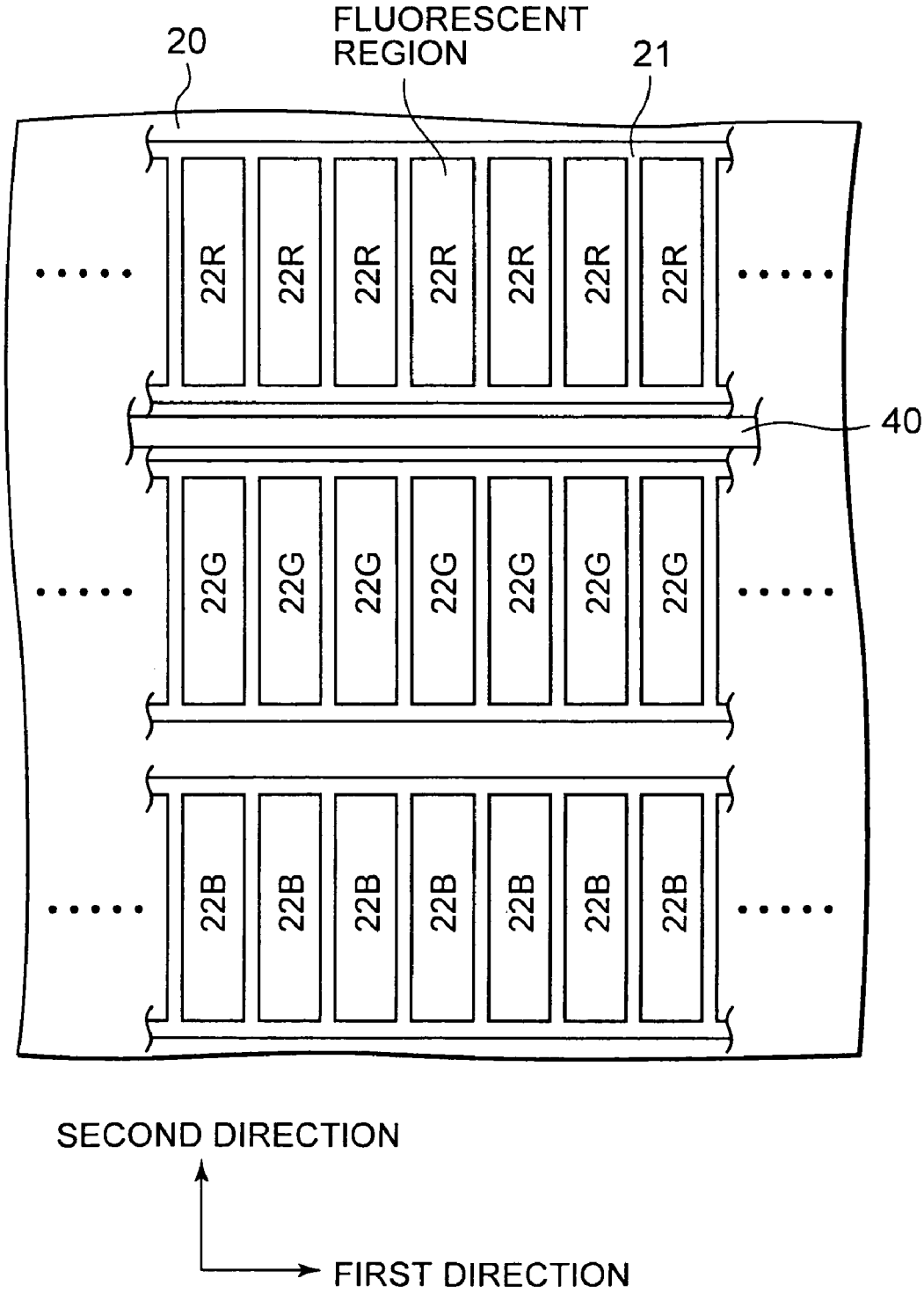
FIG. 14 is a view diagrammatically showing the arrangement of the barrier, spacer, and fluorescent regions in the anode panel constituting the flat-type display device.
Figure 15:
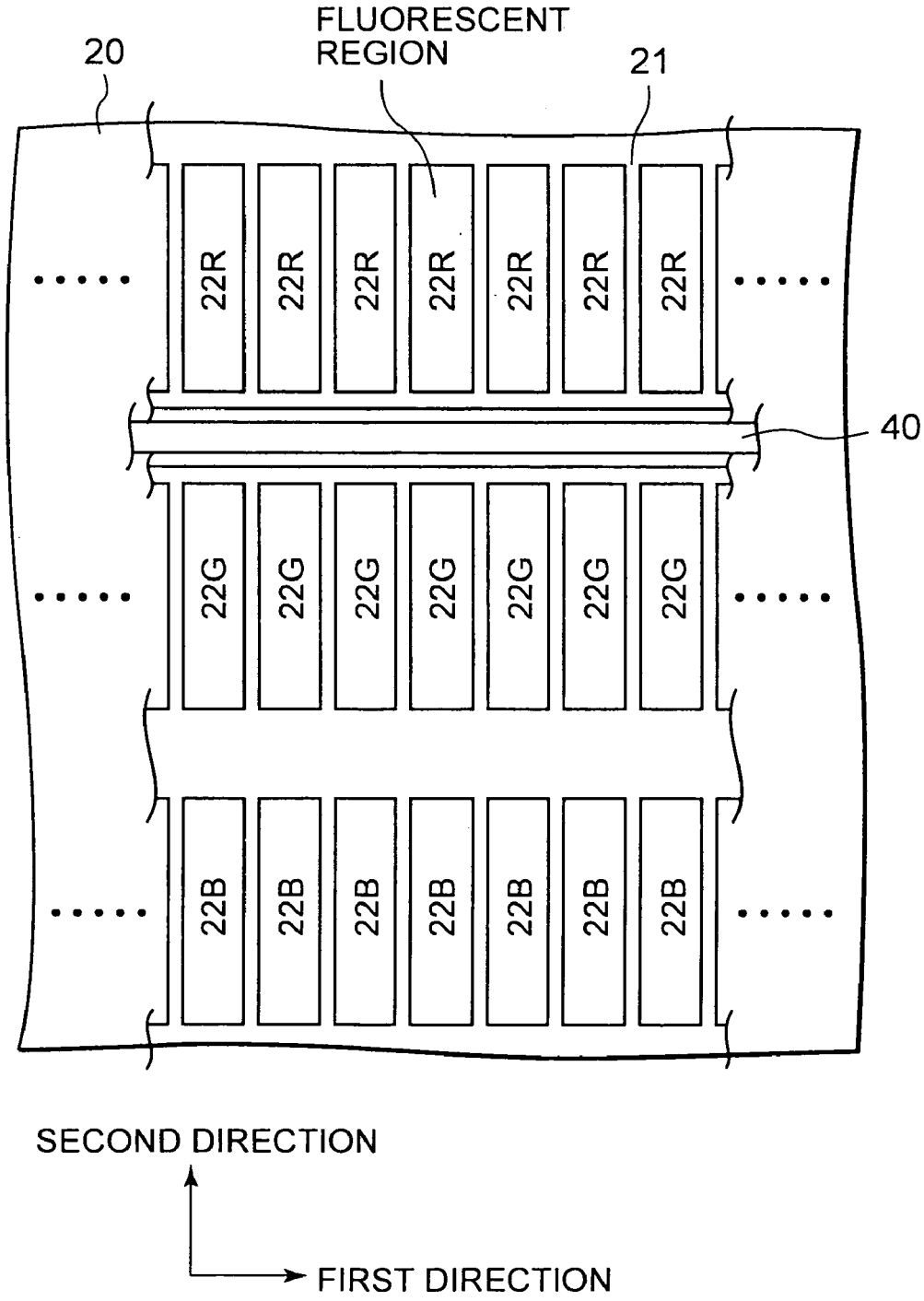
FIG. 15 is a view diagrammatically showing the arrangement of the barrier, spacer, and fluorescent regions in the anode panel constituting the flat-type display device.
Figure 16:
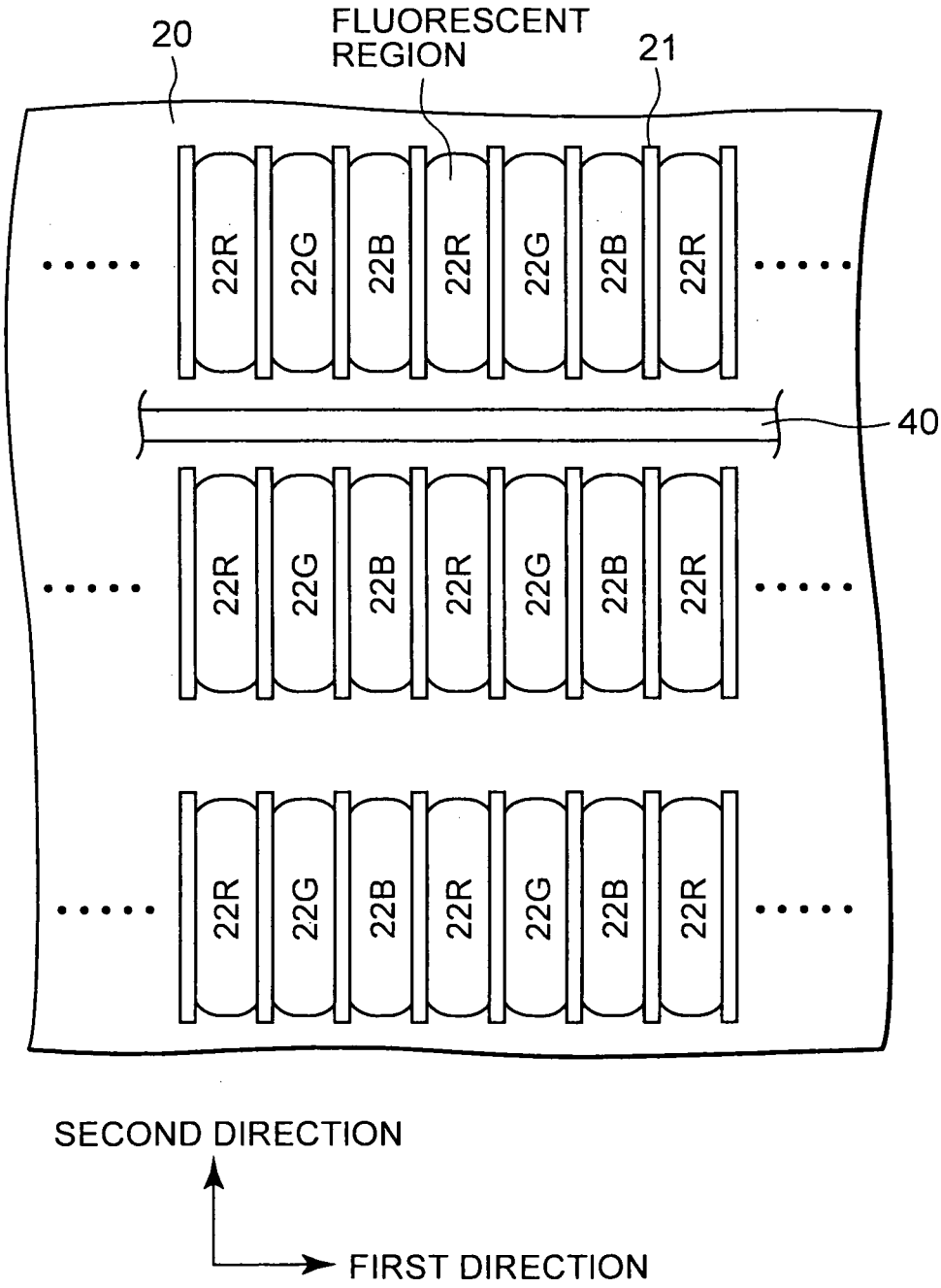
FIG. 16 is a view diagrammatically showing the arrangement of the barrier, spacer, and fluorescent regions in the anode panel constituting the flat-type display device.
Figure 17:
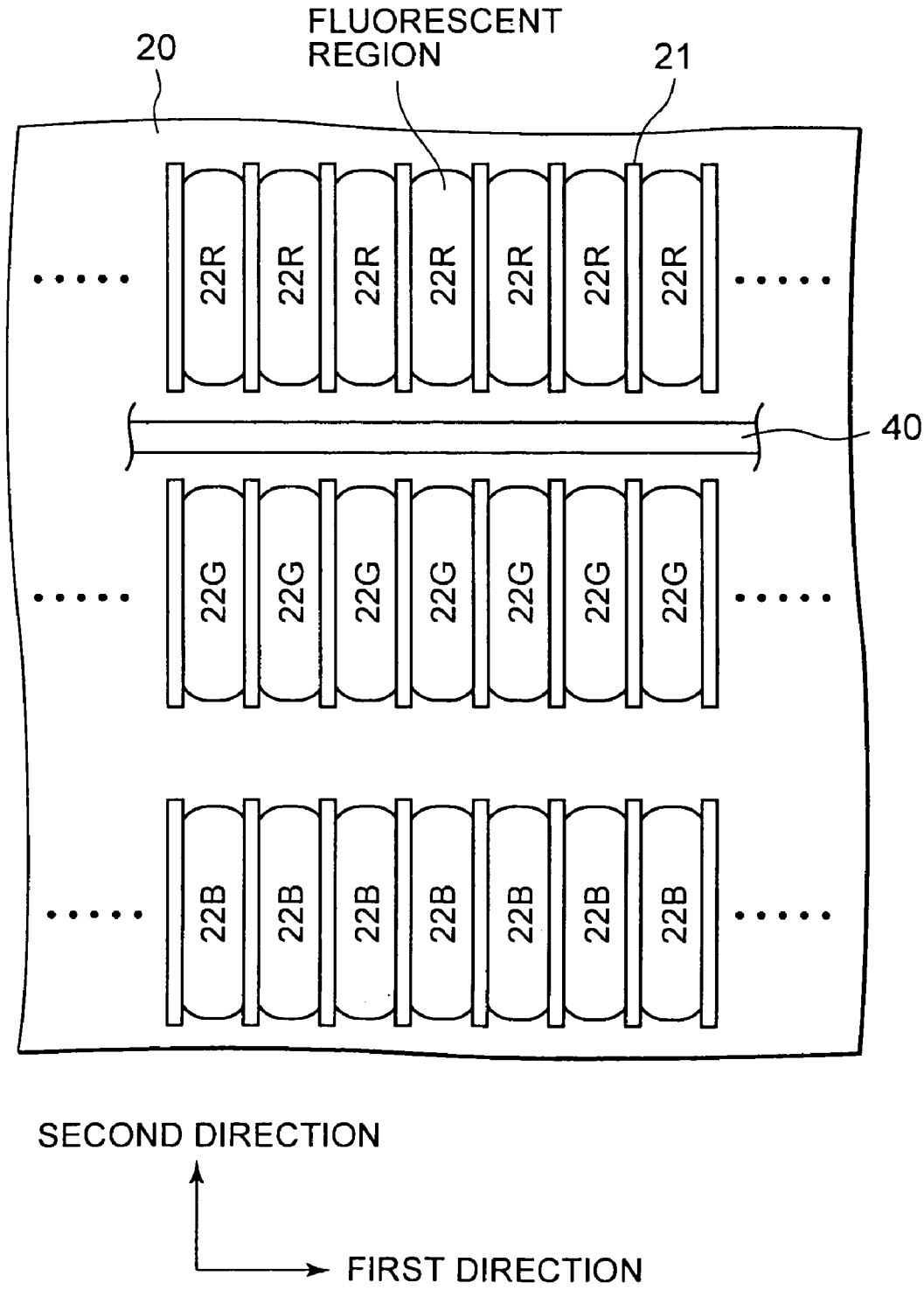
FIG. 17 is a view diagrammatically showing the arrangement of the barrier, spacer, and fluorescent regions in the anode panel constituting the flat-type display device.

Examples of arrangements of the barrier 21, spacer 40, and fluorescent regions 22 in the display devices in Examples 1 to 9 are diagrammatically shown in FIGS. 12 to 17. The arrangements of the fluorescent regions and others in the display devices shown in FIGS. 7, 8, 10, and 11 are shown in FIG. 13 or FIG. 15. In FIGS. 1-2 to 17, the anode electrode is not shown. Examples of flat forms of the barrier 21 include a lattice-like form (form of parallel crosses), specifically, a form surrounding the four sides of the fluorescent region 22 corresponding to one subpixel and having, for example, a flat form of substantially rectangular form (see FIGS. 12, 13, 14, and 15), and a strip form extending parallel to the opposite two sides of the substantially rectangular (or strip-form) fluorescent region 22 (see FIGS. 16 and 17). In the fluorescent regions 22 shown in FIG. 16, the fluorescent regions 22R, 22G, 22B can be in the form of a strip extending in the vertical direction in FIG. 16. Part of the barrier 21 serves also as a spacer holder for holding the spacer 40. In FIGS. 6 to 11, the spacer holder is not shown.

In the display devices in Examples 1 to 9, plate-form spacers 40 extending in the first direction (see the X direction shown in the figures) are arranged in P rows (specifically, 7 rows in a 20-inch display device) between the cathode panel CP and the anode panel AP. Q (=90) pieces of first electrodes (gate electrodes 13) are disposed between one spacer 40 and another spacer 40. That is, in FIGS. 6 to 11, the spacers 40 extend in the first direction (X direction, i.e., direction perpendicular to the plane of the paper of each figure). The spacer 40 or a spacer member constituting the spacer is composed of alumina ($Al_2O_3$; purity: 99.8% by weight), and a resistance between the top surface and the bottom surface of the spacer 40 (or spacer member) is about $1\times10^{10}\Omega$ (about 10 GΩ; resistivity: about $6\times10^{7}\ \Omega\cdot m$). An antistatic film (not shown) composed of chromium oxide ($CrO_x$) having a thickness of 4 nm is formed on the sidewall of the spacer 40 (or spacer member) by an RF sputtering process. Chromium oxide has a relatively small coefficient of secondary electron emission, and hence is a very preferred material for the antistatic film under conditions such that the spacer 40 (or spacer member) is positively charged.

In the display devices in Examples 1 to 9, the cathode electrode 11 is connected to a cathode electrode control circuit 31, the gate electrode 13 is connected to a gate electrode control circuit 32, and, in a case where a focusing electrode 17 is provided, the focusing electrode 17 is connected to a focusing electrode control circuit 33, and the anode electrode 24 is connected to an anode electrode control circuit 34. These control circuits can be configured with a known circuit. In the actual display operation of the display device, the anode voltage $V_A$ applied to the anode electrode 24 from the anode electrode control circuit 34 is generally constant, and can be, for example, 5 kV to 15 kV, specifically, e.g., 9 kV (e.g., $D_0$=2.0 mm). On the other hand, with respect to the voltage $V_C$ applied to the cathode electrode 11 and the voltage $V_G$ applied to the gate electrode 13 in the actual display operation of the display device, any one of the following systems can be employed:

(1) a system in which the voltage $V_C$ applied to the cathode electrode 11 is constant, and the voltage $V_G$ applied to the gate electrode 13 is changed;

(2) a system in which the voltage $V_C$ applied to the cathode electrode 11 is changed, and the voltage $V_G$ applied to the gate electrode 13 is constant; and (3) a system in which the voltage $V_C$ applied to the cathode electrode 11 is changed, and the voltage $V_G$ applied to the gate electrode 13 is changed.

In the display devices in Examples 1 to 9, the system of item (2) above is employed.

Specifically, in the actual display operation of the display device, a relatively negative voltage ($V_C$) is applied to the cathode electrode 11 from the cathode electrode control circuit 31, a relatively positive voltage ($V_G$) is applied to the gate electrode 13 from the gate electrode control circuit 32, and, in a case where a focusing electrode 17 is provided, for example, 0 V is applied to the focusing electrode 17 from the focusing electrode control circuit 33, and a positive voltage (anode voltage $V_A$) higher than the voltage applied to the gate electrode 13 is applied to the anode electrode 24 from the anode electrode control circuit 34. In display made by the display device, for example, a video signal is input into the cathode electrode 11 from the cathode electrode control circuit 31, and a scanning signal is input into the gate electrode 13 from the gate electrode control circuit 32. In a case where the cathode electrode 11 is the first electrode (scanning electrode) and the gate electrode 13 is the second electrode (data electrode), a scanning signal may be input into the cathode electrode 11 from the cathode electrode control circuit 31, and a video signal may be input into the gate electrode 13 from the gate electrode control circuit 32. An electric field resulting from applying a voltage across the cathode electrode 11 and the gate electrode 13 causes the electron emitter 15 or 15A to emit electrons due to a quantum tunnel effect, and the electrons are attracted by the anode electrode 24 and pass through the anode electrode 24 and collide with the fluorescent regions 22, so that the fluorescent regions 22 are excited to emit light, thus obtaining a desired image. Accordingly, the operation of the display device is basically controlled by changing the voltage $V_G$ applied to the gate electrode 13 and the voltage $V_C$ applied to the cathode electrode 11.

Example 1

Example 1 is directed to the method for driving a flat-type display device of the present invention. The display device in Example 1 or Examples 2 to 9 described below can be any one of the display devices shown in FIGS. 6 to 11. In the following descriptions, the electron emitter area near the spacer 40 is frequently referred to as "near electron emitter area $EA_{near}$", and the electron emitter area which is not near the spacer 40 is frequently referred to as "far electron emitter area $EA_{far}$". The first electrode near the spacer 40 is frequently referred to as "near first electrode", and the first electrode which is not near the spacer 40 is frequently referred to as "far first electrode".

In the non-display operation period of the display device, the near electron emitter areas $EA_{near}$ are non-display-driven, and a first current $I_{near}$ carried by electrons emitted from the near electron emitter areas $EA_{near}$ is measured to determine a normalized first current $I_{Nor_near}$. In addition, the far electron emitter areas $EA_{far}$ are non-display-driven, and a second current $I_{far}$ carried by electrons emitted from the far electron emitter areas $EA_{far}$ is measured to determine a normalized second current $I_{Nor_far}$. In the actual display operation period of the display device, the driving conditions for the electron emitter areas $EA_{near}$, $EA_{far}$ (e.g., the voltage applied to the first electrode and second electrode) are set based on the normalized first current $I_{Nor_near}$ and normalized second current $I_{Nor_far}$ so that the electron emission conditions in the near electron emitter areas $EA_{near}$ and the electron emission conditions in the far electron emitter areas $EA_{far}$ are substantially the same (specifically, so that, for example, the luminance values are substantially the same).

Further, in Example 1, (P−1) first electrode groups are disposed between one spacer 40 and another spacer 40 in which each first electrode group is composed of Q first electrodes (gate electrodes 13), where, in the Q first electrodes (gate electrodes 13), R (R≧1) first electrode(s) {near first electrode(s)} constitutes or constitute electron emitter areas near one spacer 40 (near electron emitter areas $EA_{near}$) and R' (R'≧1) first electrode(s) {near first electrode(s) 9} constitutes or constitute electron emitter areas near another spacer 40 (near electron emitter areas $EA_{near}$), wherein the near electron emitter areas $EA_{near}$ composed of the near first electrodes of from the 1st near first electrode nearest the one spacer 40 to the R-th near first electrode and the (Q−R'+1)-th through Q-th near first electrodes are non-display-driven every each near first electrode (each gate electrode 13), and a first current $I_{near(r)}$ (where r=1, 2, . . . , R, and Q−R'+1, . . . , Q−1, Q) carried by electrons emitted from the near electron emitter areas $EA_{near}$ is independently measured to independently determine a normalized first current $I_{Nor_near(r)}$. In addition, the far electron emitter areas $EA_{far}$ composed of the (R+1)-th through (Q−R')-th far first electrodes are independently non-display-driven, and a second current $I_{far_sum}$ carried by electrons emitted from the far electron emitter areas $EA_{far}$ is independently measured to determine a normalized second current $I_{Nor_far}$.

In this way, the first current $I_{near(r)}$ is measured every near first electrode (gate electrode 13). It is desired that the driving conditions for non-display-driving the electron emitter areas EA in the non-display operation period of the display device are the same as the driving conditions for display-driving the electron emitter areas EA in the actual display operation period of the display device such that the largest current is obtained (the difference between the voltage applied to the gate electrode 13 as the first electrode and the voltage applied to the cathode electrode 11 as the second electrode is the largest), but the driving conditions are not limited to them. In a case where the optimum correction value varies depending on the video signal level, measurements are individually conducted for a plurality of signal levels to determine interpolation data for an arbitrary signal level, thus enabling more precise correction.

In Example 1 or the Examples described below, R=R'=3.

The state of application of a voltage to the first electrode (gate electrode 13) is shown in FIG. 1, and, in FIG. 1 or FIGS. 2 to 5 mentioned below, the p-th, (p+1)-th, and (p+2)-th spacers 40 are shown, and further the (p−1, Q)-th first electrode, the (p, 1)-th through (p, Q)-th first electrodes (the p-th first electrode group), the (p+1, 1)-th through (p+1, Q)-th first electrodes {the (p+1)-th first electrode groups}, and the (p+2, 1)-th through (p+2, 4)-th first electrodes are shown. The second electrodes are not shown. In FIGS. 1 to 5, a plurality of longitudinal straight lines are shown on the right-hand side of each figure, and these lines mean electric currents flowing the anode electrode or focusing electrode.

Lines [A] to [H] shown in FIG. 1 designate electric currents as follows. Current $I_{(p,\ q)}$ means a current carried by electrons emitted from the electron emitter areas EA comprised of the q-th first electrode (gate electrode 13) in the p-th first electrode group disposed between the p-th spacer 40 and the (p+1)-th spacer 40.

Line [A]=current $I_{(p,\ 1)}$, current $I_{(p+1,\ 1)}$, or current $I_{(p+2,\ 1)}$ . . .
Line [B]=current $I_{(p,\ 2)}$, current $I_{(p+1,\ 2)}$, or current $I_{(p+2,\ 2)}$ . . .
Line [C]=current $I_{(p,\ 3)}$, current $I_{(p+1,\ 3)}$, or current $I_{(p+2,\ 3)}$ . . .
Line [D]=current $I_{(p,\ 4)}$, current $I_{(p+1,\ 4)}$, or current $I_{(p+2,\ 4)}$ . . .
Line [E]=current $I_{(p,\ Q-3)}$, current $I_{(p+1,\ Q-3)}$, or current $I_{(p+2,\ Q-3)}$ . . .
Line [F]=current $I_{(p,\ Q-2)}$, current $I_{(p+1,\ Q-2)}$, or current $I_{(p+2,\ Q-2)}$ . . .
Line [G]=current $I_{(p,\ Q-1)}$, current $I_{(p+1,\ Q-1)}$, or current $I_{(p+2,\ Q-1)}$ . . .
Line [H]=current $I_{(p,\ Q)}$, current $I_{(p+1,\ Q)}$, or current $I_{(p+2,\ Q)}$ . . .

In Example 1, $$I_{Nor_near(r)}=I_{near(r)}/N$$

or $$I_{Nor_near(r)}=I_{near(r)}.$$

More specifically, R=R'=3, and therefore, $$I_{Nor_near(1)}=I_{near(1)}/N$$

$$I_{Nor_near(2)}=I_{near(2)}/N$$

$$I_{Nor_near(3)}=I_{near(3)}/N$$

$$I_{Nor_near(Q-2)}=I_{near(Q-2)}/N$$

$$I_{Nor_near(Q-1)}=I_{near(Q-1)}/N$$

$$I_{Nor_near(Q)}=I_{near(Q)}/N.$$

Specifically, the number of the far electron emitter areas $EA_{far}$ which are non-display-driven is (Q−R−R')×N, and the number of the far first electrodes (gate electrodes 13) constituting the far electron emitter areas $EA_{far}$ which are non-display-driven is Q−R−R'. Therefore, $$I_{Nor_far}=\Sigma I_{far(q)}/\{(Q-R-R')\times N\}$$

or $$I_{Nor_far}=\Sigma I_{far(q)}/(Q-R-R').$$

Symbol "Σ" herein means to determine the total current of from a current $I_{far(R+1)}$ to a current $I_{far(Q-R')}$, more specifically means to determine the total current of from a current $I_{far(4)}$ to a current $I_{far(Q-3)}$.

As mentioned above, in the actual display operation period of the flat-type display device, the driving conditions for the electron emitter areas EA are set on the basis of the normalized first current $I_{Nor_near}$ and the normalized second current $I_{Nor_far}$ so that the electron emission conditions in the near electron emitter areas $EA_{near}$ and the electron emission conditions in the far electron emitter areas $EA_{far}$ are substantially the same. Specifically, in the actual display operation period of the display device, the driving conditions for the electron emitter areas EA are set on the basis of the normalized first current $I_{Nor_near}$ and the normalized second current $I_{Nor_far}$ every each near first electrode constituting the near electron emitter areas $EA_{near}$ so that the electron emission conditions in the near electron emitter areas $EA_{near}$ composed of the near first electrodes and the electron emission conditions in the far electron emitter areas $EA_{far}$ are substantially the same (specifically, so that, for example, the luminance values are substantially the same). More specifically, for example, a linear sequential driving mode is employed, the first electrode (gate electrode 13) is used as a scanning electrode, and the second electrode (cathode electrode 11) is used as a data electrode, and hence, a voltage $V_{1_far}$ applied to the first electrode (gate electrode 13) constituting the far electron emitter areas $EA_{far}$, which is constant, a voltage $V_2$ applied to the second electrode (cathode electrode 11) constituting the electron emitter areas EA, which is variable according the video signal, and a voltage (constant value) $V_{1_near}$ applied to the near first electrode (gate electrode 13) constituting the near electron emitter areas $EA_{near}$ may satisfy the formula (1) above.

As mentioned above, the $I_{Nor_far/INor_near}$ value and the $V_{1_near}$ value according to this value are stored as a kind of reference table in memory means in the display device, so that the voltage value $V_{1_near}$ can be fed to the electron emitter areas EA by a known method.

Here, the non-display operation period of the display device can be a predetermined period of time (e.g., several seconds) from the start of power supply to the display device (switching on). In this case, the non-display operation of the display device is finished and then, an actual display operation of the display device is started. In the actual display operation of the display device, the driving conditions for the electron emitter areas EA are set on the basis of the normalized first current $I_{Nor_near}$ and the normalized second current $I_{Nor_far}$ or the like so that the electron emission conditions in the near electron emitter areas $EA_{near}$ and the electron emission conditions in the far electron emitter areas $EA_{far}$ are substantially the same. Alternatively, the non-display operation period of the display device can be a predetermined period of time (e.g., several seconds) from the termination of power supply to the display device (switching off). In this case, the non-display operation of the display device is finished and then, the operation of the display device is completely stopped. In the next actual display operation of the display device, the driving conditions for the electron emitter areas EA are set on the basis of the normalized first current $I_{Nor_near}$ and normalized second current $I_{Nor_far}$ or the like so that the electron emission conditions in the near electron emitter areas $EA_{near}$ and the electron emission conditions in the far electron emitter areas $EA_{far}$ are substantially the same. This applies to Examples 2 to 9 described below.

In Example 1, in the non-display operation period of the display devices shown in FIGS. 6 to 11, the near electron emitter areas $EA_{near}$ are non-display-driven and a first current $I_{near}$ carried by electrons which are emitted from the near electron emitter areas $EA_{near}$ and collide with the anode electrode 24 is measured, and the far electron emitter areas $EA_{far}$ are non-display-driven and a second current $I_{far}$ carried by electrons which are emitted from the far electron emitter areas $EA_{far}$ and collide with the anode electrode 24 is measured. In this case, for example, $V_A$=10 kV, $V_{A_test}/V_A$=0.2 where $V_{A_test}$ represents a voltage applied to the anode electrode 24 in the non-display operation period of the display device, and $V_A$ represents a voltage applied to the anode electrode 24 in the actual display operation period of the display device. According to the voltage $V_{A_test}$ applied to the anode electrode 24 in the non-display operation period of the display device, there may be a case where substantially no image is displayed on the display device. A first current $I_{near}$ or second current $I_{far}$ carried by electrons which collide with the anode electrode 24 is measured, specifically, e.g., a current flowing the anode electrode 24 (anode current) may be measured. The above descriptions can be applied to Examples 2 to 9 described below. A current flowing the cathode electrode 11 can be measured in principle, but a driver to which the cathode electrode 11 is connected is a simple device for switching the voltage driving and hence, it is not preferred to measure a current through such a driver.

Alternatively, in Example 1, in the non-display operation period of the display devices shown in FIGS. 9 to 11, a construction can be employed in which the near electron emitter areas $EA_{near}$ are non-display-driven and a first current $I_{near}$ carried by electrons which are emitted from the near electron emitter areas $EA_{near}$ and collide with the focusing electrode 17 is measured, and the far electron emitter areas $EA_{far}$ are non-display-driven and a second current $I_{far}$ carried by electrons which are emitted from the far electron emitter areas $EA_{far}$ and collide with the focusing electrode 17 is measured. In this construction, substantially no image is displayed on the display device. In this case, as an example of a voltage $V_{F_test}$ applied to the focusing electrode 17, there can be mentioned a voltage obtained by adding 50 V to the voltage applied to the first electrode (gate electrode 13). A first current $I_{near}$ or second current $I_{far}$ carried by electrons which collide with the focusing electrode 17 is measured, specifically, e.g., a current flowing the focusing electrode 17 may be measured. The above descriptions can be applied to Examples 2 to 9 described below.

Example 2

Example 2 is a variation on Example 1. In Example 2, the operations of measuring the first currents $I_{near(r)}$ in the respective (P−1) first electrode groups disposed between one spacer 40 and another spacer 40 are performed simultaneously in the (P−1) groups, and the normalized first current $I_{Nor_near(r)}$ is determined from the sum $I_{near_sum(r)}$ of (P−1) first currents $I_{near(r)}$ from the individual first electrode groups.

In Example 2, lines [A] to [H] shown in FIG. 1 designate electric currents as follows.

$$\text{Line } [A] = \text{current } I_{near_sum(1)} = \ldots + \text{current } I_{(p,1)} + \text{current } I_{(p+1,1)} + \text{current } I_{(p+2,1)} + \ldots$$

$$\text{Line } [B] = \text{current } I_{near_sum(2)} = \ldots + \text{current } I_{(p,2)} + \text{current } I_{(p+1,2)} + \text{current } I_{(p+2,2)} + \ldots$$

$$\text{Line } [C] = \text{current } I_{near_sum(3)} = \ldots + \text{current } I_{(p,3)} + \text{current } I_{(p+1,3)} + \text{current } I_{(p+2,3)} + \ldots$$

$$\text{Line } [D] = \text{current } I_{far_sum(4)} = \ldots + \text{current } I_{(p,4)} + \text{current } I_{(p+1,4)} + \text{current } I_{(p+2,4)} + \ldots$$

$$\text{Line } [E] = \text{current } I_{far_sum(Q-3)} = \ldots + \text{current } I_{(p,Q-3)} + \text{current } I_{(p+1,Q-3)} + \text{current } I_{(p+2,Q-3)} + \ldots$$

$$\text{Line } [F] = \text{current } I_{near_sum(Q-2)} = \ldots + \text{current } I_{(p,Q-2)} + \text{current } I_{(p+1,Q-2)} + \text{current } I_{(p+2,Q-2)} + \ldots$$

$$\text{Line } [G] = \text{current } I_{near_sum(Q-1)} = \ldots + \text{current } I_{(p,Q-1)} + \text{current } I_{(p+1,Q-1)} + \text{current } I_{(p+2,Q-1)} + \ldots$$

$$\text{Line } [H] = \text{current } I_{near_sum(Q)} = \ldots + \text{current } I_{(p,Q)} + \text{current } I_{(p+1,Q)} + \text{current } I_{(p+2,Q)} + \ldots$$

In Example 2, $$I_{Nor_near(r)} = I_{near_sum(r)} / \{(P-1) \times N\}$$

or $$I_{Nor_near(r)} = I_{near_sum(r)} / (P-1).$$

Specifically, the number of the far electron emitter areas $EA_{far}$ which are non-display-driven is (P−1)×(Q−R—R')×N, and the number of the far first electrodes (gate electrodes 13) constituting the far electron emitter areas $EA_{far}$ which are non-display-driven is (P−1)×(Q−R—R'). Therefore, $$I_{Nor_far} = \Sigma\Sigma I_{far_sum(q)} / \{(P-1) \times (Q-R-R') \times N\}$$

or $$I_{Nor_far} = \Sigma\Sigma I_{far_sum(q)} / \{(P-1) \times (Q-R-R')\}.$$

Symbol "ΣΣ" herein means to determine the total current of from a current $I_{far_sum(R+1)}$ to a current $I_{far_sum(Q-R')}$ and further determine the sum of the total current of p=1, 2, . . . , P−1. More specifically, the symbol "ΣΣ" means to determine the total current of from a current $I_{far_sum(4)}$ to a current $I_{far_sum(Q-3)}$ and further determine the sum of the total current of p=1, 2, . . . , P−1. This applies to the following descriptions.

Example 3

Example 3 is also a variation on Example 1, and directed to the method-A for driving a flat-type display device of the present invention. In Example 1, the far electron emitter areas $EA_{faR}$ composed of the (R+1)-th through (Q−R')-th far first electrodes (gate electrodes 13) were independently non-display-driven, and a second current $I_{far_sum}$ carried by electrons emitted from the far electron emitter areas $EA_{faR}$ was measured to determine a normalized second current $I_{Nor_far}$. On the other hand, in Example 3, the far electron emitter areas $EA_{faR}$ composed of the (R+1)-th through (Q−R')-th far first electrodes (gate electrodes 13) are, for example, simultaneously non-display-driven, and a second current $I_{far_sum}$ carried by electrons emitted from the far electron emitter areas $EA_{faR}$ is measured to determine a normalized second current $I_{Nor_far}$.

In Example 3, lines [A] to [G] shown in FIG. 2 designate electric currents as follows.

$$\text{Line } [A] = \text{current } I_{(p,1)}, \text{ current } I_{(p+1,1)}, \text{ or current } I_{(p+2,1)} \ldots$$

$$\text{Line } [B] = \text{current } I_{(p,2)}, \text{ current } I_{(p+1,2)}, \text{ or current } I_{(p+2,2)} \ldots$$

$$\text{Line } [C] = \text{current } I_{(p,3)}, \text{ current } I_{(p+1,3)}, \text{ or current } I_{(p+2,3)} \ldots$$

$$\text{Line } [D] = \text{current } I_{(p,Q-2)}, \text{ current } I_{(p+1,Q-2)}, \text{ or current } I_{(p+2,Q-2)} \ldots$$

$$\text{Line } [E] = \text{current } I_{(p,Q-1)}, \text{ current } I_{(p+1,Q-1)}, \text{ or current } I_{(p+2,Q-1)} \ldots$$

$$\text{Line } [F] = \text{current } I_{(p,Q)}, \text{ current } I_{(p+1,Q)}, \text{ or current } I_{(p+2,Q)} \ldots$$

$$\begin{aligned}\text{Line } [G] = {} & \ldots + \text{current } I_{(p,4)} + \text{current } I_{(p,5)} + \text{current } I_{(p,6)} + \\ & \ldots + \text{current } I_{(p,Q-5)} + \text{current } I_{(p,Q-4)} + \text{current } I_{(p,Q-3)} + \\ & \text{current } I_{(p+1,4)} + \text{current } I_{(p+1,5)} + \text{current } I_{(p+1,6)} \ldots + \\ & \text{current } I_{(p+1,Q-5)} + \text{current } I_{(p+1,Q-4)} + \text{current } I_{(p+1,Q-3)} + \ldots\end{aligned}$$

In Example 3, $$I_{Nor_near(r)} = I_{near(r)}/N$$

or $$I_{Nor_near(r)} = I_{near(r)}.$$

Specifically, the number of the far electron emitter areas $EA_{far}$ which are non-display-driven is (P−1)×(Q−R—R')×N, and the number of the far first electrodes (gate electrodes 13) constituting the far electron emitter areas $EA_{far}$ which are non-display-driven is (P−1)×(Q−R—R'). Therefore, $$I_{Nor_far} = \Sigma\Sigma I_{far_sum(q)}/\{(P-1)\times(Q-R-R')\times N\}$$

or $$I_{Nor_far} = \Sigma\Sigma I_{far_sum(q)}/\{(P-1)\times(Q-R-R')\}.$$

Example 4

Example 4 is a variation on Example 3, and directed to the method-A' for driving a flat-type display device of the present invention. In Example 4, the operations of measuring the first currents $I_{near(r)}$ in the respective (P−1) first electrode groups disposed between one spacer 40 and another spacer 40 are performed simultaneously in the (P−1) groups, and the normalized first current $I_{Nor_near(r)}$ is determined from the sum $I_{near_sum(r)}$ of P−1 first currents $I_{near(r)}$ from the individual first electrode groups, and the normalized second current $I_{Nor_far}$ is determined from the sum $I_{far_Gsum}$ of (P−1) second currents $I_{far_sum}$ from the individual first electrode groups.

In Example 4, lines [A] to [G] shown in FIG. 2 designate electric currents as follows.

$$\text{Line } [A] = \text{current } I_{near_sum(1)} = \ldots + \text{current } I_{(p,1)} + \text{current } I_{(p+1,1)} + \text{current } I_{(p+2,1)} + \ldots$$

$$\text{Line } [B] = \text{current } I_{near_sum(2)} = \ldots + \text{current } I_{(p,2)} + \text{current } I_{(p+1,2)} + \text{current } I_{(p+2,2)} + \ldots$$

$$\text{Line } [C] = \text{current } I_{near_sum(3)} = \ldots + \text{current } I_{(p,3)} + \text{current } I_{(p+1,3)} + \text{current } I_{(p+2,3)} + \ldots$$

$$\text{Line } [D] = \text{current } I_{near_sum(Q-2)} = \ldots + \text{current } I_{(p,Q-2)} + \text{current } I_{(p+1,Q-2)} + \text{current } I_{(p+2,Q-2)} + \ldots$$

$$\text{Line } [E] = \text{current } I_{near_sum(Q-1)} = \ldots + \text{current } I_{(p,Q-1)} + \text{current } I_{(p+1,Q-1)} + \text{current } I_{(p+2,Q-1)} + \ldots$$

$$\text{Line } [F] = \text{current } I_{near_sum(Q)} = \ldots + \text{current } I_{(p,Q)} + \text{current } I_{(p+1,Q)} + \text{current } I_{(p+2,Q)} + \ldots$$

$$\begin{aligned}\text{Line } [G] = {} & \ldots + \text{current } I_{(p,4)} + \text{current } I_{(p,5)} + \text{current } I_{(p,6)} + \\ & \ldots + \text{current } I_{(p,Q-5)} + \text{current } I_{(p,Q-4)} + \\ & \text{current } I_{(p,Q-3)} + \text{current } I_{(p+1,4)} + \text{current } I_{(p+1,5)} + \\ & \text{current } I_{(p+1,6)} \ldots + \text{current } I_{(p+1,Q-5)} + \\ & \text{current } I_{(p+1,Q-4)} + \text{current } I_{(p+1,Q-3)} + \ldots\end{aligned}$$

In Example 4, $$I_{Nor_near(r)} = I_{near_sum(r)}/\{(P-1)\times N\}$$

or $$I_{Nor_near(r)} = I_{near_sum(r)}/(P-1)$$

Specifically, the number of the far electron emitter areas $EA_{far}$ which are non-display-driven is (P−1)×(Q−R—R')×N, and the number of the far first electrodes (gate electrodes 13) constituting the far electron emitter areas $EA_{far}$ which are non-display-driven is (P−1)×(Q−R—R'). Therefore, $$I_{Nor_far} = \Sigma\Sigma I_{far_sum(q)}/\{(P-1)\times(Q-R-R')\times N\}$$

or $$I_{Nor_far} = \Sigma\Sigma I_{far_sum(q)}/\{(P-1)\times(Q-R-R')\}.$$

Example 5

Example 5 is also a variation on Example 1. In Example 5, a reference normalized second current $I_{Int_Nor_far}$ is preliminarily determined by a method similar to the method described in Example 1. In the actual display operation period of the display device, the driving conditions for the electron emitter areas EA are set on the basis of the reference normalized second current $I_{Int_Nor_far}$ and normalized second current $I_{Nor_far}$ and the normalized first current $I_{Nor_near}$ and normalized second current $I_{Nor_far}$ in the same manner as in Example 1 so that the electron emission conditions in the near electron emitter areas $EA_{near}$ and the electron emission conditions in the far electron emitter areas $EA_{far}$ are substantially the same. Specifically, the driving conditions are set so that, for example, the luminance values are substantially the same). More specifically, in a case where the first electrode (gate electrode 13) is used as a scanning electrode and the second electrode (cathode electrode 11) is used as a data electrode, a voltage (constant value) $V_{1_near}$ applied to the near first electrode constituting the near electron emitter areas $EA_{near}$ can be determined from the formula (2-1) or formula (2-2) below. Even when the conditions of electron emission from the electron emitter areas EA change with time, the method having this construction can surely compensate for the change with time in the electron emission. Examples of the reference normalized second currents $I_{Int_Nor_far}$ include the normalized second current $I_{Nor_far}$ of the flat-type display device just produced and the normalized second current $I_{Nor_far}$ of the display device after a predetermined period of time (e.g., 5,000 hours, 10,000 hours, . . . ) has lapsed.

$$\gamma\cdot\ln(V_{1_near}/V_{Int_1_far})=\ln(I_{Nor_near}/I_{Int_Nor_far}) \quad (2\text{-}1)$$

$$\gamma\cdot\ln(V_{1_far}/V_{Int_1_far})=\ln(I_{Nor_far}/I_{Int_Nor_far}) \quad (2\text{-}2)$$

Example 6

Example 6 is a variation on Example 5. In Example 6, a reference normalized first current $I_{Int_Nor_near}$ is preliminarily determined by a method similar to the method described in Example 1. In the actual display operation period of the display device, the driving conditions for the electron emitter areas EA are set on the basis of the reference normalized first current $I_{Int_Nor_near}$ and normalized first current $I_{Nor_near}$ and the normalized first current $I_{Nor_near}$ and normalized second current $I_{Nor_far}$ so that the electron emission conditions in the near electron emitter areas $EA_{near}$ and the electron emission conditions in the far electron emitter areas $EA_{far}$ are substantially the same. More specifically, in a case where the first electrode (gate electrode 13) is used as a scanning electrode and the second electrode (cathode electrode 11) is used as a data electrode, a voltage (constant value) $V_{1_near}$ applied to the near first electrode (gate electrode 13) constituting the near electron emitter areas $EA_{near}$ can be determined from the formula (3-1) or formula (3-2) below. Even if the conditions of electron emission from the electron emitter areas EA change with time, the method having this construction can surely compensate for the change with time in the electron emission. Examples of the reference normalized first currents $I_{Int_Nor_near}$ include the normalized first current $I_{Nor_near}$ of the flat-type display device just produced and the normalized first current $I_{Nor_near}$ of the display device after a predetermined period of time (e.g., 5,000 hours, 10,000 hours, . . . ) has lapsed.

$$\gamma\cdot\ln(V_{1_near}/V_{Int_1_near})=\ln(I_{Nor_near}/I_{Int_Nor_near}) \quad (3\text{-}1)$$

$$\gamma\cdot\ln(V_{1_far}/V_{Int_1_near})=\ln(I_{Nor_far}/I_{Int_Nor_near}) \quad (3\text{-}2)$$

Example 7

Example 7 is also a variation on Example 1, and directed to the method-B for driving a flat-type display device of the present invention. In Example 7, (P−1) first electrode groups are disposed between one spacer 40 and another spacer 40 in which each first electrode group is composed of Q first electrodes (gate electrodes 13), where, in the Q first electrodes (gate electrodes 13), R (R≧1) first electrode(s) (near first electrode(s)) constitutes or constitute electron emitter areas near one spacer 40 (near electron emitter areas $EA_{near}$) and R' (R'≧1) first electrode(s) (far first electrode(s)) constitutes or constitute electron emitter areas near another spacer 40 (near electron emitter areas $EA_{near}$), in which the method includes the steps of:

determining a normalized first current $I_{Nor_near}$ by non-display-driving simultaneously the near electron emitter areas $EA_{near}$ composed of from the 1st near first electrode nearest the one spacer 40 to the R-th near first electrode and the (Q−R'+1)-th through Q-th near first electrodes, and measuring a first current $I_{near_sum}$ carried by electrons emitted from the near electron emitter areas $EA_{near}$, and determining a normalized second current $I_{Nor_far}$ by non-display-driving simultaneously the far electron emitter areas $EA_{far}$ composed of the (R+1)-th through (Q−R')-th far first electrodes, and measuring a second current $I_{far_sum}$ carried by electrons emitted from the far electron emitter areas $EA_{far}$; and setting the driving conditions for the electron emitter areas so that, in the R+R' near first electrodes constituting the near electron emitter areas $EA_{near}$, the electron emission conditions in the near electron emitter areas $EA_{near}$ comprised of the near first electrodes and the electron emission conditions in the far electron emitter areas $EA_{far}$ are substantially the same.

Figure 3:
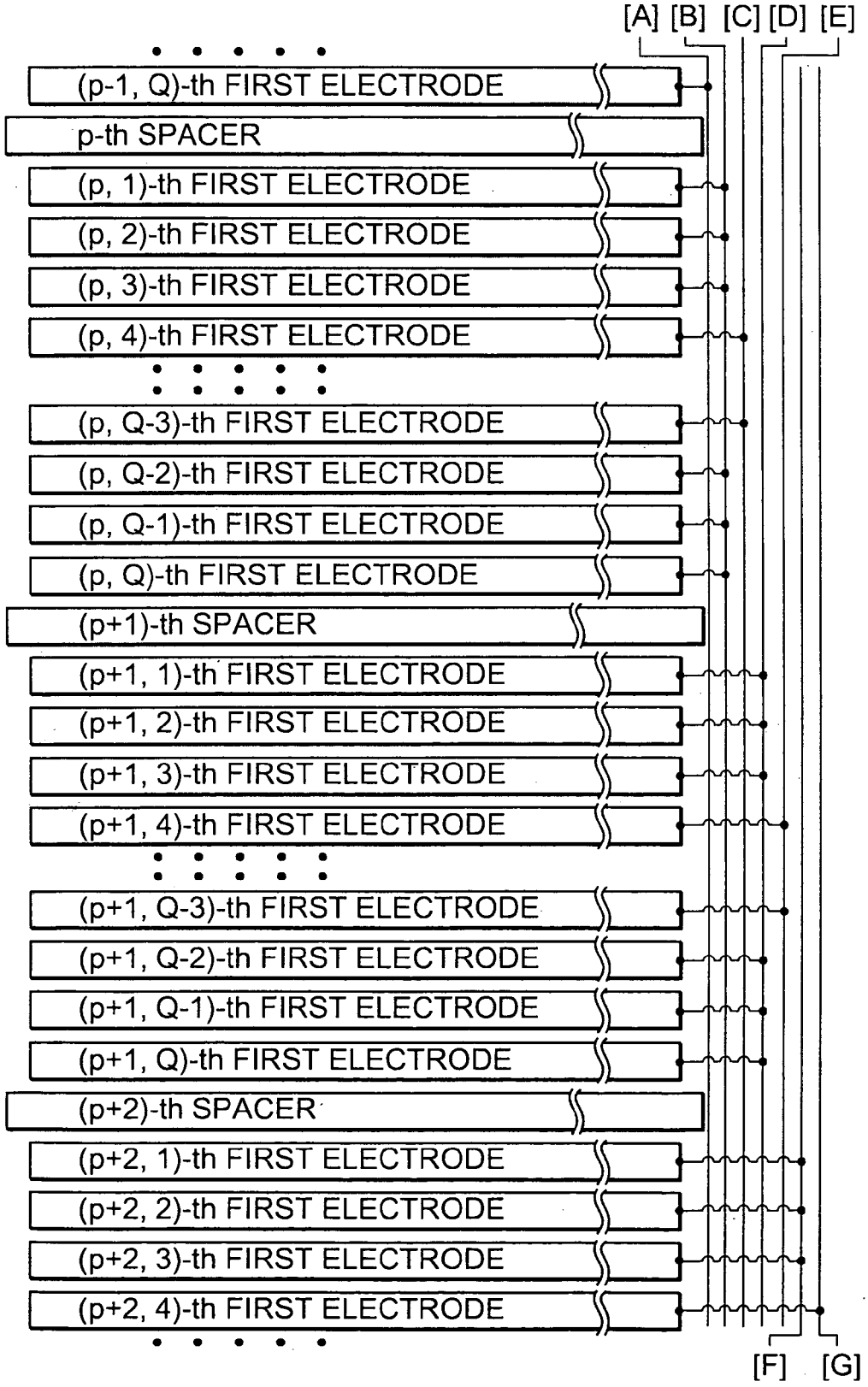
FIG. 3 is a diagram showing a state of application of a voltage to the first electrode in the method for driving a flat-type display device in Example 7.

The state of application of a voltage to the first electrode (gate electrode 13) in Example 7 is shown in FIG. 3. Lines [A] to [G] shown in FIG. 3 designate electric currents as follows.

$$\text{Line } [A] = \text{current } I_{near_sum\,(p-1)} = \text{current } I_{(p-1,1)} + \text{current } I_{(p-1,2)} + \text{current } I_{(p-1,3)} + \text{current } I_{(p-1,Q-2)} + \text{current } I_{(p-1,Q-1)} + \text{current } I_{(p-1,Q)}$$

$$\text{Line } [B] = \text{current } I_{near_sum(p)} = \text{current } I_{(p,1)} + \text{current } I_{(p,2)} + \text{current } I_{(p,3)} + \text{current } I_{(p,Q-2)} + \text{current } I_{(p,Q-1)} + \text{current } I_{(p,Q)}$$

$$\text{Line } [C] = \text{current } I_{far\,(p)} = \text{current } I_{(p,4)} + \text{current } I_{(p,5)} + \text{current } I_{(p,6)} + \ldots + \text{current } I_{(p,Q-5)} + \text{current } I_{(p,Q-4)} + \text{current } I_{(p,Q-3)}$$

$$\text{Line } [D] = \text{current } I_{near_sum\,(p+1)} = \text{current } I_{(p+1,1)} + \text{current } I_{(p+1,2)} + \text{current } I_{(p+1,3)} + \text{current } I_{(p+1,Q-2)} + \text{current } I_{(p+1,Q-1)} + \text{current } I_{(p+1,Q)}$$

$$\text{Line } [E] = \text{current } I_{far\,(p+1)} = \text{current } I_{(p+1,4)} + \text{current } I_{(p+1,5)} + \text{current } I_{(p+1,6)} + \ldots + \text{current } I_{(p+1,Q-5)} + \text{current } I_{(p+1,Q-4)} + \text{current } I_{(p+1,Q-3)}$$

$$\text{Line } [F] = \text{current } I_{near_sum\,(p+2)} = \text{current } I_{(p+2,1)} + \text{current } I_{(p+2,2)} + \text{current } I_{(p+2,3)} + \text{current } I_{(p+2,Q-2)} + \text{current } I_{(p+2,Q-1)} + \text{current } I_{(p+2,Q)}$$

$$\text{Line } [G] = \text{current } I_{far\,(p+2)} = \text{current } I_{(p+2,4)} + \text{current } I_{(p+2,5)} + \text{current } I_{(p+2,6)} + \ldots + \text{current } I_{(p+2,Q-5)} + \text{current } I_{(p+2,Q-4)} + \text{current } I_{(p+2,Q-3)}$$

Figure 4:
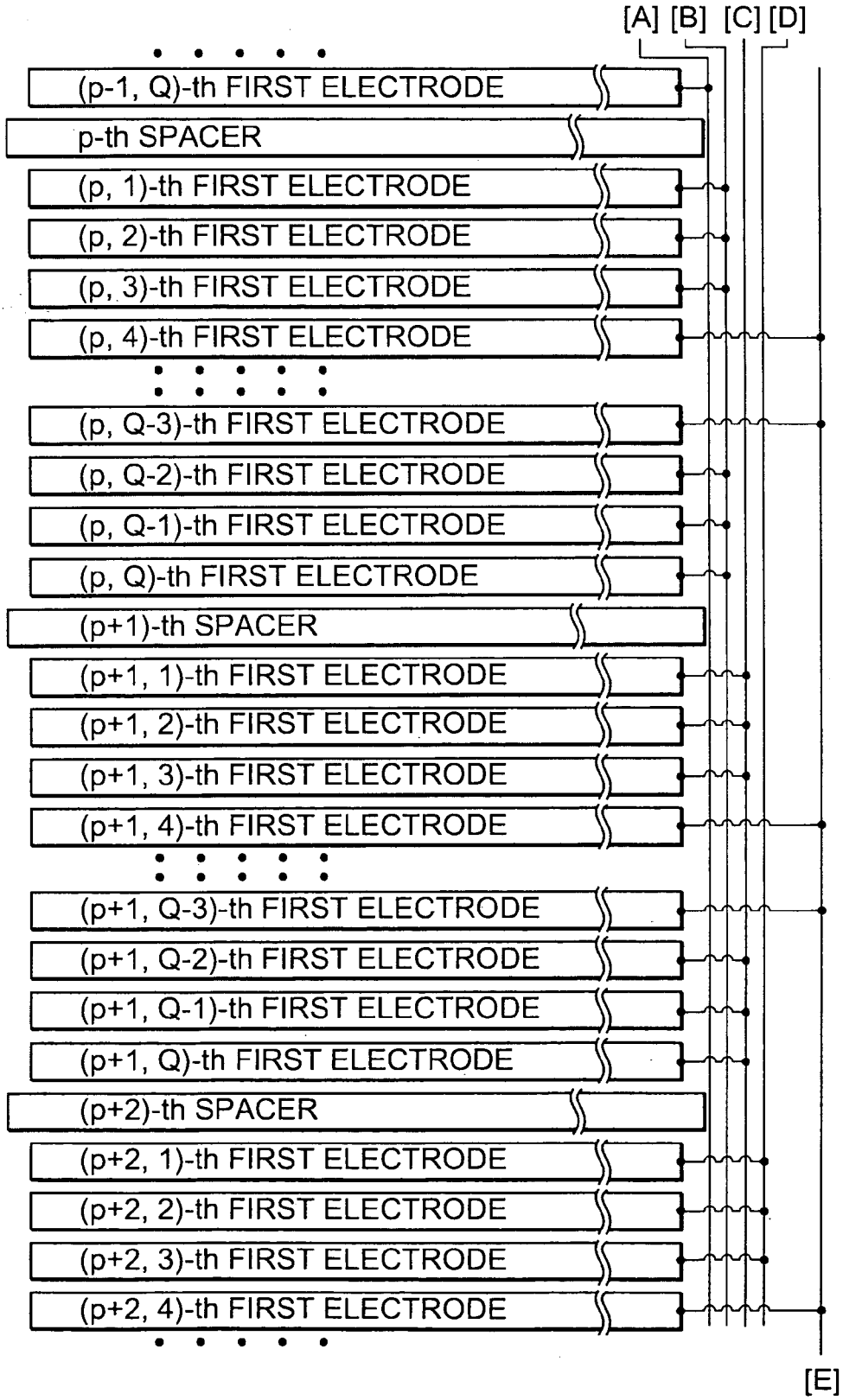
FIG. 4 is a diagram showing another example of the state of application of a voltage to the first electrode in the method for driving a flat-type display device in Example 7.

Alternatively, the state of application of a voltage to the first electrode (gate electrode 13) in Example 7 is shown in FIG. 4. Lines [A] to [E] shown in FIG. 4 designate electric currents as follows.

$$\text{Line } [A] = \text{current } I_{near_sum(p-1)} = \text{current } I_{(p-1,1)} + \text{current } I_{(p-1,2)} + \text{current } I_{(p-1,3)} + \text{current } I_{(p-1,Q-2)} + \text{current } I_{(p-1,Q-1)} + \text{current } I_{(p-1,Q)}$$

$$\text{Line } [B] = \text{current } I_{near_sum(p)} = \text{current } I_{(p,1)} + \text{current } I_{(p,2)} + \text{current } I_{(p,3)} + \text{current } I_{(p,Q-2)} + \text{current } I_{(p,Q-1)} + \text{current } I_{(p,Q)}$$

$$\text{Line } [C] = \text{current } I_{near_sum(p+1)} = \text{current } I_{(p+1,1)} + \text{current } I_{(p+1,2)} + \text{current } I_{(p+1,3)} + \text{current } I_{(p+1,Q-2)} + \text{current } I_{(p+1,Q-1)} + \text{current } I_{(p+1,Q)}$$

$$\text{Line } [D] = \text{current } I_{near_sum(p+2)} = \text{current } I_{(p+2,1)} + \text{current } I_{(p+2,2)} + \text{current } I_{(p+2,3)} + \text{current } I_{(p+2,Q-2)} + \text{current } I_{(p+2,Q-1)} + \text{current } I_{(p+2,Q)}$$

$$\text{Line } [E] = \ldots + \text{current } I_{(p,4)} + \text{current } I_{(p,5)} + \text{current } I_{(p,6)} + \ldots + \text{current } I_{(p,Q-5)} + \text{current } I_{(p,Q-4)} + \text{current } I_{(p,Q-3)} + \text{current } I_{(p+1,4)} + \text{current } I_{(p+1,5)} + \text{current } I_{(p+1,6)} \ldots + \text{current } I_{(p+1,Q-5)} + \text{current } I_{(p+1,Q-4)} + \text{current } I_{(p+1,Q-3)} + \ldots$$

In Example 7, in the non-display operation period of the display device, a first current $I_{near_sum(p)}$ is measured to determine a normalized first current $I_{Nor_near(p)}$. Specifically, the number of the near electron emitter areas $EA_{near}$ which are non-display-driven is (R+R')×N (where R=R'=3), and the number of the near first electrodes constituting the near electron emitter areas $EA_{near}$ which are non-display-driven is R+R', and therefore, a normalized first current $I_{Nor_near(p)}$ can be determined from the following formula:

$$I_{Nor_near(p)} = I_{near_sum(p)} / \{(R+R') \times N\}$$

or $$I_{Nor_near(p)} = I_{near_sum(p)} / (R+R').$$

Further, in the non-display operation period of the display device, all the far electron emitter areas $EA_{far}$, which are not near the spacer 40, composed of Q−R−R' far first electrodes are simultaneously non-display-driven, and a second current $I_{far(p)}$ carried by electrons emitted from the far electron emitter areas $EA_{far}$ is measured to determine a normalized second current $I_{Nor_far(p)}$. Specifically, the number of the far electron emitter areas $EA_{far}$ which are non-display-driven is (Q−R−R')×N, and the number of the far first electrodes constituting the far electron emitter areas $EA_{far}$ which are non-display-driven is Q−R−R', and therefore, a normalized second current $I_{Nor_far(p)}$ can be determined from the following formula:

$$I_{Nor_far(p)} = I_{far(p)} / \{(Q-R-R') \times N\}$$

or $$I_{Nor_far(p)} = I_{far(p)} / (Q-R-R').$$

The method for driving a flat-type display device described in Example 7 or below-mentioned Example 8 and the method for driving a flat-type display device described in Examples 2 to 6 may be used in combination.

Example 8

Example 8 is a variation on Example 7, and directed to the method-B' for driving a flat-type display device of the present invention. In Example 8, the operations of measuring the first currents $I_{near_sum}$ in the respective (P−1) first electrode groups are performed simultaneously in the (P−1) groups, and the normalized first current $I_{Nor_near}$ is determined from the sum $I_{near_Gsum}$ of (P−1) first currents $I_{near_sum}$ from the individual first electrode groups, and the normalized second current $I_{Nor_far}$ is determined from the sum $I_{far_Gsum}$ of (P−1) second currents $I_{far_sum}$ from the individual first electrode groups.

Figure 5:
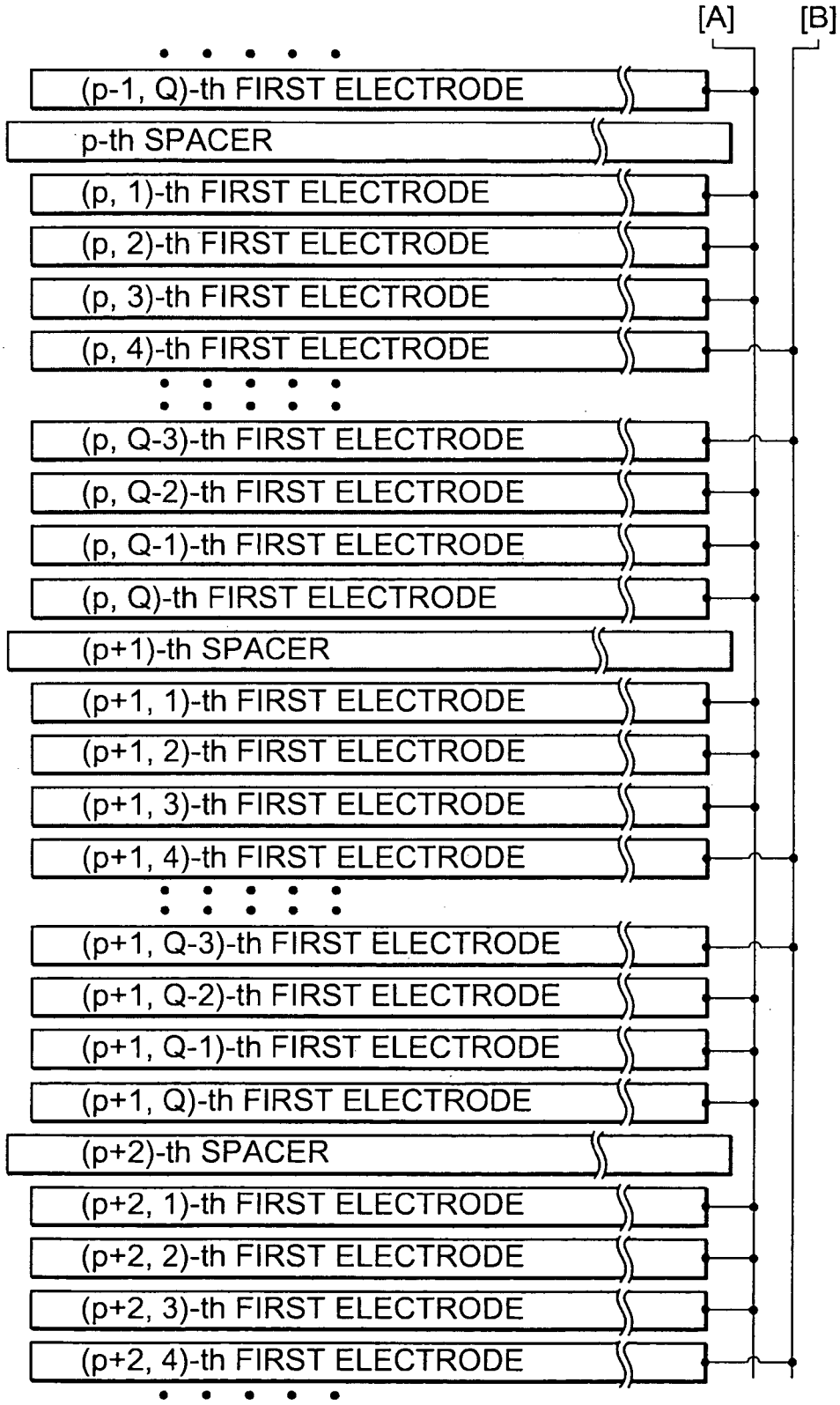
FIG. 5 is a diagram showing a state of application of a voltage to the first electrode in an example of variation on the method for driving a flat-type display device in Example 8.

In Example 8, lines [A] and [B] shown in FIG. 5 designate electric currents as follows.

$$\text{Line } [A] = \text{current } I_{near_sum} = \ldots + \text{current } I_{(p,1)} + \text{current } I_{(p+1,1)} + \text{current } I_{(p+2,1)} + \ldots + \text{current } I_{(p,2)} + \text{current } I_{(p+1,2)} + \text{current } I_{(p+2,2)} \ldots + \text{current } I_{(p,3)} + \text{current } I_{(p+1,3)} + \text{current } I_{(p+2,3)} + \ldots + \text{current } I_{(p,Q-2)} + \text{current } I_{(p+1,Q-2)} + \text{current } I_{(p+2,Q-2)} + \ldots + \text{current } I_{(p,Q-1)} + \text{current } I_{(p+1,Q-1)} + \text{current } I_{(p+2,Q-1)} + \ldots + \text{current } I_{(p,Q)} + \text{current } I_{(p+1,Q)} + \text{current } I_{(p+2,Q)} + \ldots$$

$$\text{Line } [B] = \text{current } I_{far} = \ldots + \text{current } I_{(p,4)} + \text{current } I_{(p+1,4)} + \text{current } I_{(p+2,4)} + \ldots + \text{current } I_{(p,5)} + \text{current } I_{(p+1,5)} + \text{current } I_{(p+2,5)} + \ldots + \text{current } I_{(p,6)} + \text{current } I_{(p+1,6)} + \text{current } I_{(p+2,6)} + \ldots\ldots + \text{current } I_{(p,Q-5)} + \text{current } I_{(p+1,Q-5)} + \text{current } I_{(p+2,Q-5)} + \ldots + \text{current } I_{(p,Q-4)} + \text{current } I_{(p+1,Q-4)} + \text{current } I_{(p+2,Q-4)} + \ldots + \text{current } I_{(p,Q-3)} + \text{current } I_{(p+1,Q-3)} + \text{current } I_{(p+2,Q-3)} + \ldots$$

In Example 8, in the non-display operation period of the display device, a first current $I_{near_sum}$ is measured to determine a normalized first current $I_{Nor_near}$. Specifically, the number of the near electron emitter areas $EA_{near}$ which are non-display-driven is (P−1)×(R+R')×N (where R=R'=3), and the number of the near first electrodes constituting the near electron emitter areas $EA_{near}$ which are non-display-driven is (P−1)×(R+R'), and therefore, a normalized first current $I_{Nor_near}$ can be determined from the following formula:

$$I_{Nor_near} = I_{near_sum} / \{(P-1) \times (R+R') \times N\}$$

or $$I_{Nor_near} = I_{near_sum} / \{(P-1) \times (R+R')\}$$

Further, in the non-display operation period of the display device, all the far electron emitter areas $EA_{far}$, which are not near the spacer 40, composed of (P−1)×(Q−R—R') far first electrodes are simultaneously non-display-driven, and a second current $I_{far}$ carried by electrons emitted from the far electron emitter areas $EA_{far}$ is measured to determine a normalized second current $I_{Nor_far}$. Specifically, the number of the far electron emitter areas $EA_{far}$ which are non-display-driven is (P−1)×(Q−R—R')×N, and the number of the far first electrodes constituting the far electron emitter areas $EA_{far}$ which are non-display-driven is (P−1)×(Q−R−R'), and therefore, a normalized second current $I_{Nor_far}$ can be determined from the following formula:

$$I_{Nor_far} = I_{far} / \{(P-1) \times (Q-R-R') \times N\}$$

or $$I_{Nor_far} = I_{far} / \{(P-1) \times (Q-R-R')\}.$$

Example 9

Example 9 is also a variation on Example 1. In Example 9, a non-display driving time $T_{OP_test}$ of the electron emitter areas EA in the non-display operation period of the display device can be longer than a display driving time $T_{OP}$ of the electron emitter areas EA in the actual display operation period of the display device. An example of the $T_{OP_test}/T_{OP}$ relationship may include $T_{OP_test}/T_{OP}=20$. The display driving time $T_{OP}$ corresponds to the duty term, which is a value in terms of second obtained by dividing a refresh time (e.g., 16.7 msec at 60 Hz) of a frame by M. Thus, non-display-driving the display device at a low frequency not only can increase the measured current to improve the measurement precision but also can prevent the occurrence of a problem in that the driving current wave form in the non-display driving broadens to lower the measurement precision.

The method for driving a flat-type display device described in Example 9 and the method for driving a flat-type display device described in Examples 2 to 8 may be used in combination.

Hereinabove, the present invention is described with reference to the preferred Examples, which should not be construed as limiting the scope of the present invention. The constructions and structures of the flat-type display devices, cathode panels, anode panels, cold cathode field emission display devices, and cold cathode field emitter elements described in the Examples are merely examples and can be appropriately changed. With respect to the display device, color display is generally described as an example, but monochromatic display can be made.

In the Examples, when the number of the first electrodes constituting each of the (P−1) first electrode groups disposed between one spacer and another spacer is Q, the first electrode group disposed between one spacer and another spacer is described as an aggregate, but, in the present invention, q first electrodes (where q represents an integer satisfying: $R \leqq q$) being present in one region defined by the spacers and having R near first electrodes and (Q-q) first electrodes being present in another region defined by the spacers and having R' near first electrodes can be a first electrode group.

In the Examples, the construction in which the gate electrode 13 corresponds to the first electrode and the cathode electrode 11 corresponds to the second electrode is employed, but a construction in which the cathode electrode 11 corresponds to the first electrode and the gate electrode 13 corresponds to the second electrode can alternatively be employed. The electron emitter area is composed of an overlap region between the first electrode and the second electrode, but the mode in which "the electron emitter area is composed of an overlap region between the first electrode and the second electrode" involves: a mode in which a branch line (first branch line) extends from the first electrode, a branch line (second branch line) extends from the second electrode, and an overlap region between the first branch line and the second branch line corresponds to the electron emitter area; a mode in which a branch line (first branch line) extends from the first electrode, a branch line (second branch line) extends from the second electrode, and the electron emitter area is formed on a portion through which the first branch line and the second branch line face each other (the electron emitter area is formed across the end of the first branch line and the end of the second branch line); a mode in which a branch line (first branch line) extends from the first electrode and an overlap region between the first branch line and the second electrode corresponds to the electron emitter area; a mode in which a branch line (first branch line) extends from the first electrode and the electron emitter area is formed on a portion through which the first branch line and the second electrode face each other (the electron emitter area is formed across the end of the first branch line and the side of the second electrode); a mode in which a branch line (second branch line) extends from the second electrode and an overlap region between the second branch line and the first electrode corresponds to the electron emitter area; and a mode in which a branch line (second branch line) extends from the second electrode and the electron emitter area is formed on a portion through which the second branch line and the first electrode face each other (the electron emitter area is formed across the end of the second branch line and the side of the first electrode).

In the Examples, the N electron emitter areas comprised of one first electrode are non-display-driven at the same time, but, alternatively, the N electron emitter areas composed of one first electrode are divided into a plurality of regions, and the electron emitter areas in the divided regions may be simultaneously non-display-driven. In this case, in the actual display operation period of the flat-type display device, the driving conditions for the electron emitter areas are set on the basis of the normalized first current $I_{Nor_near}$ and normalized second current $I_{Nor_far}$ so that the electron emission conditions in the electron emitter areas near the spacers and the electron emission conditions in the electron emitter areas which are not near the spacers are substantially the same, and, in addition to the state of application of a voltage to the first electrode, the state of application of a voltage to the second electrode may be controlled every electron emitter areas in the divided regions. That is, a kind of bias voltage may be applied to the second electrode every electron emitter areas in the divided regions.

With respect to the field emitter element, a form in which one electron emitter corresponds to one opening is described above, but, depending on the structure, the field emitter element may have a form in which a plurality of electron emitters correspond to one opening or a form in which one electron emitter corresponds to a plurality of openings. Alternatively, the field emitter element may have a form in which a plurality of first openings are formed in the gate electrode and a second opening communicating with the first openings is formed in the insulating layer and one or a plurality of electron emitters are formed.

The electron emitter areas can be composed of an electron emitter element called surface conductive-type electron emitter element. The surface conductive-type electron emitter element has, on a support composed of, e.g., glass, a pair of electrodes having fine areas and having a predetermined gap therebetween, which are composed of a conductor, such as tin oxide ($SnO_2$), gold (Au), indium oxide ($In_2O_3$)/tin oxide ($SnO_2$), carbon, or palladium oxide (PdO), and which are formed in a matrix form. A carbon thin film is formed on each electrode. The electrodes have a construction such that a horizontal wiring is connected to one of the electrodes (e.g., first electrode) and a vertical wiring is connected to another (e.g., second electrode). By applying a voltage to the electrodes (first electrode and second electrode), an electric field is made between the carbon thin films facing each other through a gap, so that electrons are emitted from the carbon thin films. The electrons are permitted to collide with the fluorescent regions on the anode panel, so that the fluorescent regions are excited to emit light, thus obtaining a desired image. Alternatively, the electron emitter areas can be composed of a metal/insulating film/metal element.

In the method for driving a flat-type display device according to the embodiment of the present invention, the normalized first current $I_{Nor_near}$ and normalized second current $I_{Nor_far}$ in the non-display operation period of the flat-type display device are determined, and, in the actual display operation period of the flat-type display device, the driving conditions for the electron emitter areas are set based on the normalized first current $I_{Nor_near}$ and normalized second current $I_{Nor_far}$ so that the electron emission conditions in the near electron emitter areas and the electron emission conditions in the far electron emitter areas are substantially the same. Therefore, the difference between the light emission conditions in the fluorescent regions near the spacers and the light emission conditions in the fluorescent regions which are not near the spacers in the flat-type display device can be as small as possible, thus making it possible to provide a high display-quality flat-type display device having extremely uniform luminance. In addition, the measured current can be increased to improve the measurement precision, enabling correction with high precision, and the correction is conducted in a period of time excluding the display operation period, and hence there is no adverse effect on the image display. Further, a simple ammeter or line memory can be used, and therefore the measurement does not increase the production cost for the flat-type display device. Furthermore, by preliminarily determining the reference normalized second current $I_{Int_Nor_far}$ or reference normalized first current $I_{Int_Nor_near}$, even when the conditions of electron emission from the electron emitter areas change with time, the method can easily and surely compensate for the change with time in the electron emission.

It should be understood by those skilled in the art that various modifications, combinations, sub-combinations and alterations may occur depending on design requirements and other factors insofar as they are within the scope of the appended claims or the equivalents thereof.

What is claimed is:

1. A method for driving a flat-type display device which includes:

(A) a cathode panel having M strip-form first electrodes extending in a first direction and N strip-form second electrodes extending in a second direction different from the first direction, and having N×M electron emitter areas composed of overlap regions between the first electrodes and the second electrodes; and (B) an anode panel having a fluorescent region and an anode electrode, the cathode panel and the anode panel being joined together at their edges through a joint member, the cathode panel and the anode panel having therebetween spacers extending in the first direction arranged in P rows, the method comprising the steps of:

in the non-display operation period of the flat-type display device, determining a normalized first current $I_{Nor_near}$ by non-display-driving the electron emitter areas near the spacers and by measuring a first current $I_{near}$ carried by electrons emitted from the electron emitter areas, and determining a normalized second current $I_{Nor_far}$ by non-display-driving the electron emitter areas which are not near the spacers and by measuring a second current $I_{far}$ carried by electrons emitted from the electron emitter areas; and in the actual display operation period of the flat-type display device, setting the driving conditions for the electron emitter areas on the basis of the normalized first current $I_{Nor_near}$ and normalized second current $I_{Nor_far}$ so that the electron emission conditions in the electron emitter areas near the spacers and the electron emission conditions in the electron emitter areas which are not near the spacers are substantially the same.

2. The method according to claim 1, wherein (P−1) first electrode groups are disposed between one spacer and another spacer wherein each first electrode group is composed of Q first electrodes, where, in the Q first electrodes, R (R≧1) first electrode(s) constitutes or constitute electron emitter areas near one spacer and R' (R'≧1) first electrode(s) constitutes or constitute electron emitter areas near another spacer, wherein the method comprises the steps of:

determining a normalized first current $I_{Nor_near(r)}$ by non-display-driving the electron emitter areas composed of the first electrodes of from the 1st first electrode nearest the one spacer to the R-th first electrode and the (Q−R'+1)-th through Q-th first electrodes every each first electrode, and by measuring a first current $I_{near(r)}$ (wherein r=1, 2, . . . , R, and Q−R'+1, . . . , Q−1, Q) carried by electrons emitted from the electron emitter areas, determining a normalized second current $I_{Nor_far}$ by non-display-driving the electron emitter areas composed of the (R+1)-th through (Q−R')-th first electrodes, and by measuring a second current $I_{far_sum}$ carried by electrons emitted from the electron emitter areas; and setting the driving conditions for the electron emitter areas every each first electrode constituting the electron emitter areas near the spacers so that the electron emission conditions in the electron emitter areas comprised of the first electrodes and the electron emission conditions in the electron emitter areas which are not near the spacers are substantially the same.

3. The method according to claim 2, wherein the operations of measuring the first currents $I_{near(r)}$ in the respective (P−1) first electrode groups are performed simultaneously in the (P−1) groups, and the normalized first current $I_{Nor_near(r)}$ is determined from the sum $I_{near_sum(r)}$ of (P−1) first currents $I_{near(r)}$ from the individual first electrode groups, and wherein the normalized second current $I_{Nor_far}$ is determined from the sum $I_{far_Gsum}$ of (P−1) second currents $I_{far_sum}$ from the individual first electrode groups.

4. The method according to claim 1, wherein (P−1) first electrode groups are disposed between one spacer and another spacer wherein each first electrode group is comprised of Q first electrodes, where, in the Q first electrodes, R (R≧1) first electrode(s) constitutes or constitute electron emitter areas near one spacer and R' (R'≧1) first electrode(s) constitutes or constitute electron emitter areas near another spacer, wherein the method comprises the steps of:

determining a normalized first current $I_{Nor_near}$ by non-display-driving simultaneously the electron emitter areas composed of the first electrodes of from the 1st first electrode nearest the one spacer to the R-th first electrode and the (Q−R'+1)-th through Q-th first electrodes, and by measuring a first current $I_{near_sum}$ carried by electrons emitted from the electron emitter areas, determining a normalized second current $I_{Nor_far}$ by non-display-driving simultaneously the electron emitter areas composed of the (R+1)-th through (Q−R')-th first electrodes, and by measuring a second current $I_{far_sum}$ carried by electrons emitted from the electron emitter areas; and setting the driving conditions for the electron emitter areas so that in the R+R' first electrodes constituting the electron emitter areas near the spacers, the electron emission conditions in the electron emitter areas composed of the first electrodes and the electron emission conditions in the electron emitter areas which are not near the spacers are substantially the same.

5. The method according to claim 4, wherein the operations of measuring the first currents $I_{near_sum}$ in the respective (P−1) first electrode groups are performed simultaneously in the (P−1) groups, and the normalized first current $I_{Nor_near}$ is determined from the sum $I_{near_Gsum}$ of (P−1) first currents $I_{near_sum}$ from the individual first electrode groups, and wherein the normalized second current $I_{Nor_far}$ is determined from the sum $I_{far_Gsum}$ of (P−1) second currents $I_{far_sum}$ from the individual first electrode groups.

6. The method according to claim 1, wherein the non-display operation period of the flat-type display device is a predetermined period of time from the start of power supply to the flat-type display device.

7. The method according to claim 1, wherein the non-display operation period of the flat-type display device is a predetermined period of time from the termination of power supply to the flat-type display device.

8. The method according to claim 1, which comprises the steps of, in the non-display operation period of the flat-type display device:

measuring a first current $I_{near}$ carried by electrons which are emitted from the electron emitter areas and collide with the anode electrode by non-display-driving the electron emitter areas near the spacers, and measuring a second current $I_{far}$ carried by electrons which are emitted from the electron emitter areas and collide with the anode electrode by non-display-driving the electron emitter areas which are not near the spacers.

9. The method according to claim 8, which satisfies the relationship: $0.05 \leqq V_{A_test}/V_A \leqq 0.5$, where $V_{A_test}$ represents a voltage applied to the anode electrode in the non-display operation period of the flat-type display device, and $V_A$ represents a voltage applied to the anode electrode in the actual display operation period of the flat-type display device.

10. The method according to claim 1, wherein the cathode panel further includes a focusing electrode, wherein the method comprises the steps of, in the non-display operation period of the flat-type display device:

measuring a first current $I_{near}$ carried by electrons which are emitted from the electron emitter areas and collide with the focusing electrode by non-display-driving the electron emitter areas near the spacers, and measuring a second current $I_{far}$ carried by electrons which are emitted from the electron emitter areas and collide with the focusing electrode by non-display-driving the electron emitter areas which are not near the spacers.

11. The method according to claim 1, wherein a non-display driving time $T_{OP_test}$ of the electron emitter areas in the non-display operation period of the flat-type display device is longer than a display driving time Top of the electron emitter areas in the actual display operation period of the flat-type display device.

12. The method according to claim 1, which comprises the steps of:

determining a reference normalized second current $I_{Int_Nor_far}$, and, in the actual display operation period of the flat-type display device, setting the driving conditions for the electron emitter areas based on the reference normalized second current $I_{Int_Nor_far}$ and normalized second current $I_{Nor_far}$ and the normalized first current $I_{Nor_near}$ and normalized second current $I_{Nor_far}$ so that the electron emission conditions in the electron emitter areas near the spacers and the electron emission conditions in the electron emitter areas which are not near the spacers are substantially the same.

13. The method according to claim 1, which comprises the steps of:

determining a reference normalized first current $I_{Int_Nor_near}$, and, in the actual display operation period of the flat-type display device, setting the driving conditions for the electron emitter areas based on the reference normalized first current $I_{Int_Nor_near}$ and normalized first current $I_{Nor_near}$ and the normalized first current $I_{Nor_near}$ and normalized second current $I_{Nor_far}$ so that the electron emission conditions in the electron emitter areas near the spacers and the electron emission conditions in the electron emitter areas which are not near the spacers are substantially the same.

* * * * *